US011896189B2

(12) United States Patent
Lin et al.

(10) Patent No.: US 11,896,189 B2
(45) Date of Patent: Feb. 13, 2024

(54) SELF-MOVING CLEANING DEVICE

(71) Applicant: HOBOT TECHNOLOGY INC., Hsinchu County (TW)

(72) Inventors: Chia-Chin Lin, Hsinchu County (TW); Chao-Kuo Yueh, Hsinchu County (TW); Wei-Bo Ding, Hsinchu County (TW); Chun-Yao Chen, Hsinchu County (TW)

(73) Assignee: HOBOT TECHNOLOGY INC., Hsinchu County (TW)

( * ) Notice: Subject to any disclaimer, the term of this patent is extended or adjusted under 35 U.S.C. 154(b) by 16 days.

(21) Appl. No.: 17/562,305

(22) Filed: Dec. 27, 2021

(65) Prior Publication Data

US 2023/0028444 A1 Jan. 26, 2023

(30) Foreign Application Priority Data

Jul. 22, 2021 (CN) ..... 202110830193.3

(51) Int. Cl.
*A47L 9/04* (2006.01)
*A47L 9/14* (2006.01)
(Continued)

(52) U.S. Cl.
CPC ..... *A47L 9/0477* (2013.01); *A47L 9/1409* (2013.01); *A47L 9/2842* (2013.01); *A47L 9/2847* (2013.01);
(Continued)

(58) Field of Classification Search
CPC .... A47L 9/0477; A47L 9/1409; A47L 9/2842; A47L 9/2847; A47L 9/2852; A47L 9/04;
(Continued)

(56) References Cited

U.S. PATENT DOCUMENTS

2005/0015913 A1 1/2005 Kim et al.
2019/0029486 A1 1/2019 Suvarna et al.
2020/0298415 A1* 9/2020 Sun ..... A47L 9/16

FOREIGN PATENT DOCUMENTS

CN 201996467 U 10/2011
CN 202801479 U 3/2013
(Continued)

OTHER PUBLICATIONS

English translation of CN 201996467U (Year: 2011).*
(Continued)

*Primary Examiner* — Laura C Guidotti
*Assistant Examiner* — Sukwoo James Chang
(74) *Attorney, Agent, or Firm* — WPAT LAW; Anthony King

(57) ABSTRACT

A self-moving cleaning device includes: a base; a mobile module adjacent to the base and configured to contact a surface when the self-moving cleaning device moves on the surface; a vacuum module arranged over the base; a dust box arranged over the base and connected to the vacuum module, the dust box including a first opening and a second opening; a first suction port arranged on the base and including a first suction inlet connected to the first opening; a second suction port arranged on the base and including a second suction inlet connected to the second opening, the first suction port disposed between a front side of the base and the second suction port; a roller brush device arranged on the base and within the second suction port; and an air duct, wherein the first suction port is connected to the dust box through the air duct to thereby connect the first suction inlet to the first opening.

20 Claims, 15 Drawing Sheets

(51) Int. Cl.
*A47L 9/28* (2006.01)
*A47L 11/40* (2006.01)

(52) U.S. Cl.
CPC ..... *A47L 9/2852* (2013.01); *A47L 11/4011* (2013.01); *A47L 11/4058* (2013.01); *A47L 11/4088* (2013.01); *A47L 2201/06* (2013.01)

(58) Field of Classification Search
CPC .... A47L 9/0494; A47L 9/066; A47L 11/4011; A47L 11/4058; A47L 11/4088; A47L 11/20; A47L 11/282; A47L 11/4041; A47L 2201/00; A47L 2201/06
See application file for complete search history.

(56) References Cited

FOREIGN PATENT DOCUMENTS

| | | | | | |
|---|---|---|---|---|---|
| CN | 205947738 | U | | 2/2017 | |
| CN | 108209717 | A | * | 6/2018 | ..... A47L 9/06 |
| CN | 207870843 | U | | 9/2018 | |
| CN | 108703719 | A | | 10/2018 | |
| CN | 109431399 | A | * | 3/2019 | ..... A47L 11/4036 |
| CN | 209789744 | U | | 12/2019 | |
| JP | 2014230745 | A | | 12/2014 | |
| JP | 2020146173 | A | | 9/2020 | |
| KR | 20190114214 | A | * | 10/2019 | ..... A47L 9/165 |
| RU | 2710508 | C1 | | 12/2019 | |
| TW | I481377 | B | | 4/2015 | |
| WO | WO2013191465 | A1 | | 12/2013 | |
| WO | WO2018041195 | A1 | | 3/2018 | |
| WO | WO2018137408 | A1 | | 8/2018 | |
| WO | WO2019214669 | A1 | | 11/2019 | |

OTHER PUBLICATIONS

English translation of WO 2013191465A1 (Year: 2013).*
English translation of CN108209717A (Year: 2018).*
English translation of CN 207870843U (Year: 2018).*
English translation of CN109431399A (Year: 2019).*
English translation of WO 2019214669A1 (Year: 2019).*
English translation of KR20190114214A (Year: 2019).*
English abstract of TWI481377B.
English abstract of WO2018041195.
English abstract translation of CN108703719A.
English abstract translation of WO2019214669A1.
English abstract translation of WO2013191465A1.
English abstract translation of CN201996467U.
English abstract translation of JP2020146173A.
English abstract translation of CN202801479U.
English abstract translation of CN207870843U.
English abstract translation of JP2014230745A.
English abstract translation of CN205947738U.
English abstract translation of RU2710508C1 from Australian patent AU2017266814B2.
English abstract translation of CN209789744U.
Search report from European Patent Office for corresponding European application 22168418.6 dated Jun. 17, 2022.
Office action and search report from Russian Patent office for corresponding Russian application 2022102299/03 (004959) dated Jul. 14, 2022.

* cited by examiner

SELF-MOVING CLEANING DEVICE

PRIORITY CLAIM AND CROSS-REFERENCE

This application claims priority to Chinese Patent Application No. 202110830193.3 filed Jul. 22, 2021, the disclosure of which is hereby incorporated by reference in its entirety.

TECHNICAL FIELD

The present disclosure is generally related to a cleaning device, and more particularly, to a self-moving cleaning device.

BACKGROUND

Currently known cleaning robots may operate using a vacuum device or using the physical properties of a roller brush to sweep up debris and suck it into a dust box. However, when the aforementioned cleaning method encounters elongated debris, e.g., human hair, pet hair, string or the like, such debris may become tightly wrapped around the bristles of the roller brush, thereby causing a blockage of the suction inlet. Therefore, a cleaning ability of the cleaning robot may be weakened, rendering the cleaning robot unable to clean a surface effectively. It is necessary to spend extra effort to remove the hair or string wrapped around the roller brush, and a feasibility of its automatic cleaning may be greatly reduced. As a result, it is necessary to develop a new design for the cleaning robots in order to solve the aforementioned shortcomings.

SUMMARY

Embodiments of the present invention provide a self-moving cleaning device, including: a base; a mobile module adjacent to the base and configured to contact a surface when the self-moving cleaning device moves on the surface; a vacuum module arranged over the base; a dust box arranged over the base and connected to the vacuum module, the dust box including a first opening and a second opening; a first suction port arranged on the base and including a first suction inlet connected to the first opening; a second suction port arranged on the base and including a second suction inlet connected to the second opening, the first suction port disposed between a front side of the base and the second suction port; a roller brush device arranged on the base and within the second suction port; and an air duct, wherein the first suction port is connected to the dust box through the air duct to thereby connect the first suction inlet to the first opening.

In some embodiments, the air duct includes a choke valve configured to open or close the air duct to allow or block an entry of an airflow into the first opening.

In some embodiments, the air duct extends, conformal to a shape of a sidewall of the second suction port of the base, from the first suction port to a location over the roller brush device to thereby connect the air duct to the dust box.

In some embodiments, an area of the first opening is greater than an area of the second opening.

In some embodiments, the first opening is disposed over the roller brush device and over the second opening. The dust box includes a bottom surface, and the second opening is higher than the bottom surface by a first distance. The second suction port is adjacent to the first suction inlet, wherein a distance between the first suction inlet and the second suction inlet is equal to or less than about 30 mm.

In some embodiments, the self-moving cleaning device further includes a plurality of first blocking sheets disposed between the first suction inlet and the second suction inlet and extending outward from the base to contact the surface when the self-moving cleaning device moves on the surface.

In some embodiments, the plurality of first blocking sheets include a first subset and a second subset, and two adjacent first blocking sheets in the first subset or the second subset are separated by a first spacing.

In some embodiments, the first spacing is less than a spacing between the first subset and the second subset; and the first subset and the second subset together form a row which is parallel to the first suction inlet.

In some embodiments, the self-moving cleaning device further includes a second blocking sheet disposed on a side of the second suction inlet opposite to the first blocking sheets, wherein a length of the second blocking sheet is greater than a length of the first suction inlet.

In some embodiments, the self-moving cleaning device further includes a side brush device disposed on a side of the base, the side brush device including a rotating shaft and at least one bristle attached to the rotating shaft, wherein the self-moving cleaning device further includes a third blocking sheet disposed between the first suction inlet and the front side of the base, wherein the third blocking sheet is disposed within a radius of rotation of the at least one bristle.

In some embodiments, the self-moving cleaning device further includes a spray module disposed on the base and extending outwardly, wherein the second suction port is disposed between the first suction port and the spray module.

In some embodiments, the self-moving cleaning device further includes a mopping module connected to the base and configured to mop the surface when the self-moving cleaning device moves on the surface, wherein the spray module is disposed between the second suction port and the mopping module.

In some embodiments, the self-moving cleaning device further includes a lifting device connected to the base and the mopping module, the lifting device configured to move the mopping module close to or away from the base. The mopping module includes: a cloth seat and a cloth arranged on a bottom surface of the cloth seat. The lifting device includes: a crank, a driving device configured to cause a rotation of the crank, and at least one fixing bar straddling the crank and connected to the cloth seat, and wherein the at least one fixing bar is configured to move the cloth seat close to or away from the base through the rotation of the crank.

In some embodiments, the crank includes: a crankshaft arranged on the base; at least one crank arm connected to the crankshaft; and a gear part arranged on the crankshaft and coupled to the driving device, whereby the driving device causes a rotation of the crankshaft in a clockwise or counterclockwise direction through the gear part, and the driving device moves an end of the at least one crank arm close to or away from the base through the rotation of the crankshaft. The gear part and the at least one crank arm are disposed on two opposite sides of the crankshaft, the at least one crank arm includes an abutment member, and the abutment member extends outward from a side of the at least one crank arm in a direction of a longitudinal axis of the crankshaft. The at least one fixing bar includes: a horizontal portion straddling the abutment member of the at least one crank arm of the crankshaft; and at least one linking member extending from at least an end of the horizontal portion to a lower side of the self-moving cleaning device, wherein the cloth seat is fastened to the at least one linking member.

In some embodiments, the lifting device further includes at least one spring connected to the base and the mopping module, wherein the at least one spring is configured to provide a downward force to the mopping module when the self-moving cleaning device moves on the surface. The at least one spring includes a first spring and a second spring, and the horizontal portion and the abutment part are disposed between the first spring and the second spring from an elevation view.

Some embodiments of the present invention provide a self-moving cleaning device, including: a base; a mobile module adjacent to the base and configured to contact a surface when the self-moving cleaning device moves on the surface; a vacuum module disposed over the base; a dust box disposed over the base and connected to the vacuum module, the dust box including a first opening and a second opening; a first suction port arranged on the base and including a first suction inlet connected to the first opening; a second suction port arranged on the base and including a second suction inlet connected to the second opening, wherein the first suction port is disposed between a front side of the base and the second suction port; a roller brush device arranged on the base and within the second suction port; a spray module disposed on the base; and a mopping module disposed between the base and the surface and configured to contact the surface during operation, wherein the first suction port, the second suction port, the spray module, and the mopping module are arranged in sequence from the front side of the base to a back side of the base.

In some embodiments, the first opening is disposed over the roller brush device and over the second opening. The dust box includes a bottom surface, and the second opening is higher than the bottom surface by a first distance.

In some embodiments, the self-moving cleaning device further includes an air duct, wherein the first suction port is connected to the dust box through the air duct so as to connect the first suction inlet to the first opening. The air duct includes a choke valve configured to open or close the air duct to allow or block an entry of an airflow to the first opening.

In some embodiments, the air duct includes a third opening connected to the first suction inlet, wherein an area of the third opening is greater than an area of the first opening.

In some embodiments, the self-moving cleaning device further includes a controller configured to perform the following steps in sequence when the self-moving cleaning device moves on the surface: vacuuming through the first suction port, vacuuming through the second suction port, performing spraying with the spray module, and performing mopping with the mopping module.

With the arrangement of the first suction inlet and the second suction inlet of the self-moving cleaning device in accordance with the present invention discussed above, elongated debris, such as hair or string, may be effectively vacuumed through the first suction inlet. Heavier and non-elongated debris may be vacuumed through the second suction inlet, such that the elongated debris will not be wrapped around the roller brush of the second suction inlet, thereby improving the efficiency of the self-moving cleaning device.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
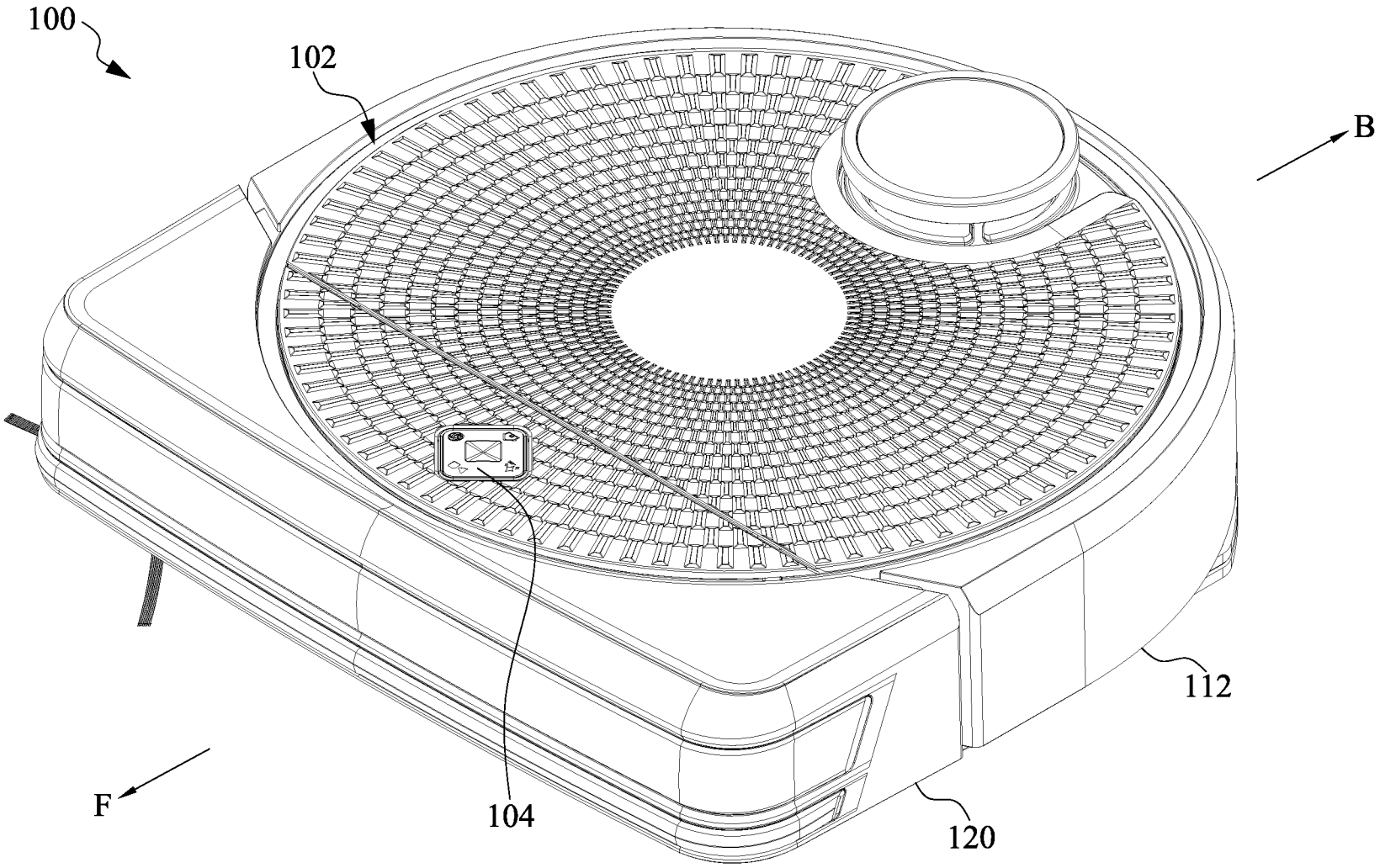
FIG. 1 shows a three-dimensional view of a self-moving cleaning device in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper," "over" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

As used herein, the terms such as "first," "second" and "third" describe various elements, components, regions, layers and/or sections, but these elements, components, regions, layers and/or sections should not be limited by these terms. These terms may be only used to distinguish one element, component, region, layer or section from another. The terms such as "first," "second" and "third" when used herein do not imply a sequence or order unless clearly indicated by the context.

It should be understood that the phraseology and terminology used herein are for the purpose of description and should not be regarded as limiting. The use of terms such as "including," "comprising" or "having" and variations thereof herein is meant to encompass the items listed thereafter and equivalents thereof as well as additional items. The terms "connected" and "coupled" are used broadly and encompass both direct and indirect mounting, connecting and coupling. Further, "connected" and "coupled" are not restricted to physical or mechanical connections or couplings.

The present disclosure relates generally to a self-moving cleaning device, which may be used to clean floors or large-area surfaces, such as stages, large-area tabletops or work platforms. The self-moving cleaning device of the present disclosure may have different types, e.g., toys, remote control cars, robots, and/or the like, and may perform cleaning while moving on a contacted surface, and accomplish the purpose of cleaning the surface by moving back and forth on the surface. A surface-cleaning robot will be used as an example for the following description, but the disclosure is not limited thereto.

Figure 2A:
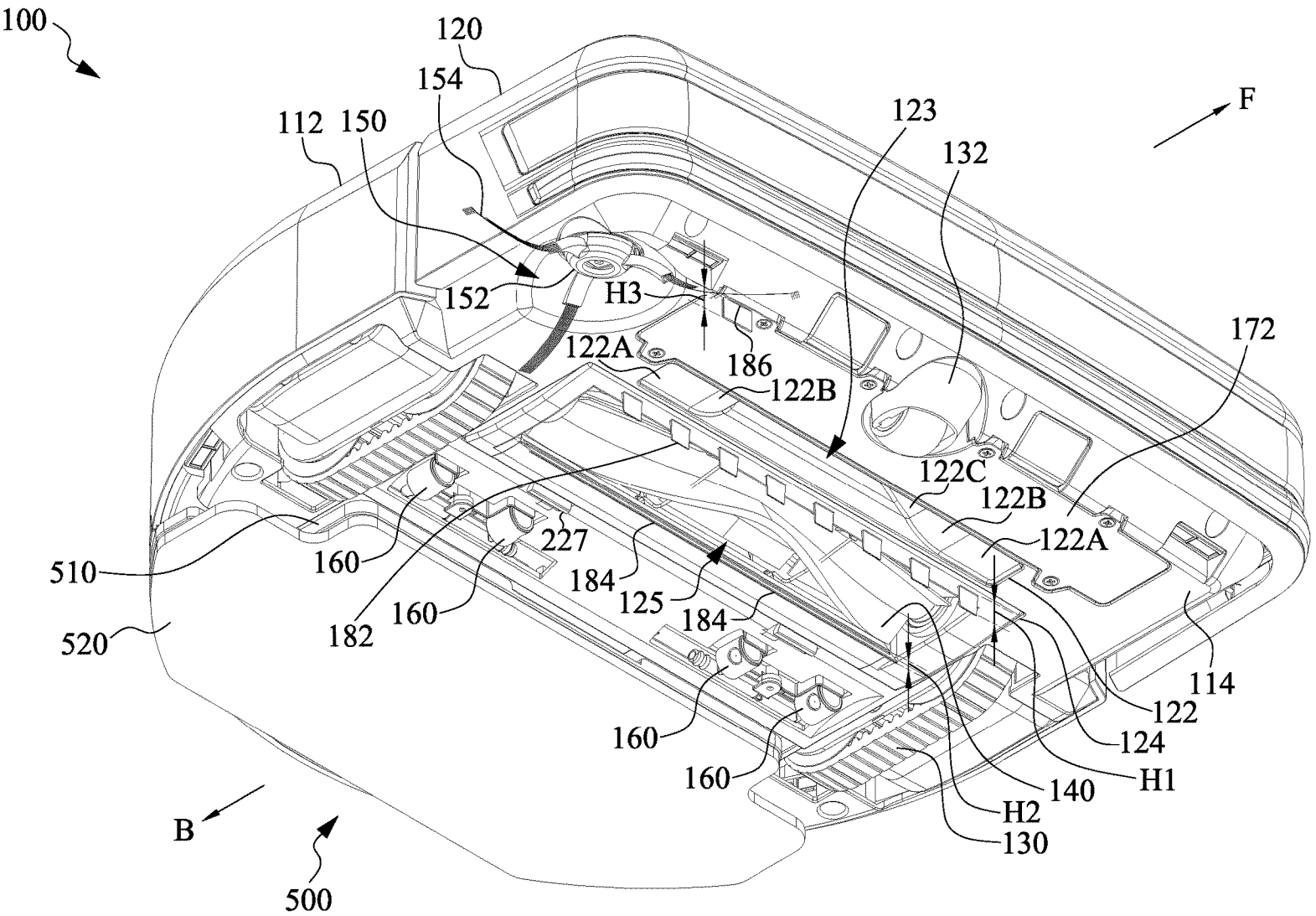
FIGS. 2A and 2B show a three-dimensional view and a bottom view, respectively, of the self-moving cleaning device in accordance with some embodiments of the present disclosure.
Figure 2B:
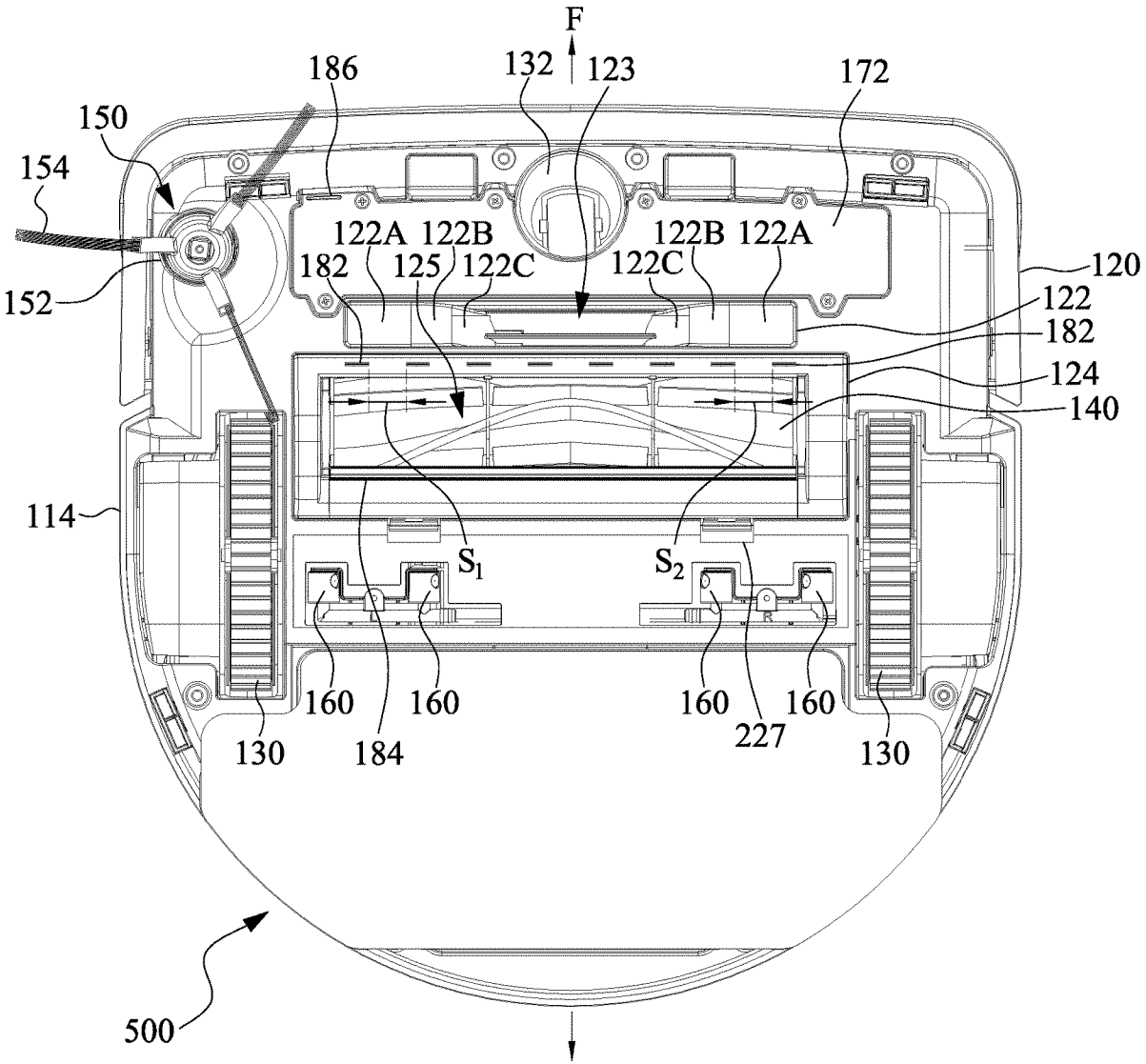
Figure 4:
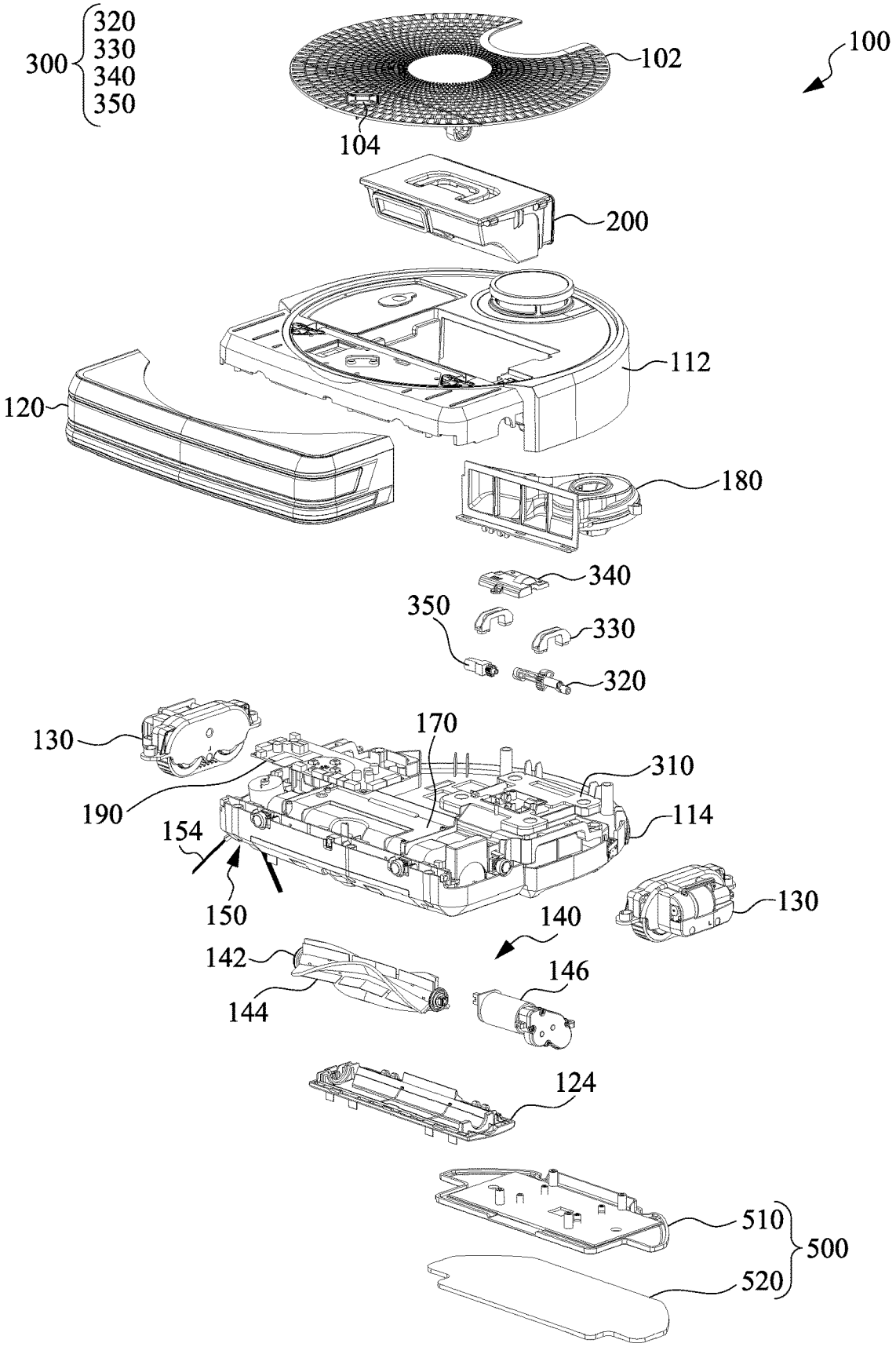
FIG. 4 shows an exploded view of the self-moving cleaning device in accordance with some embodiments of the present disclosure.
Figure 5:
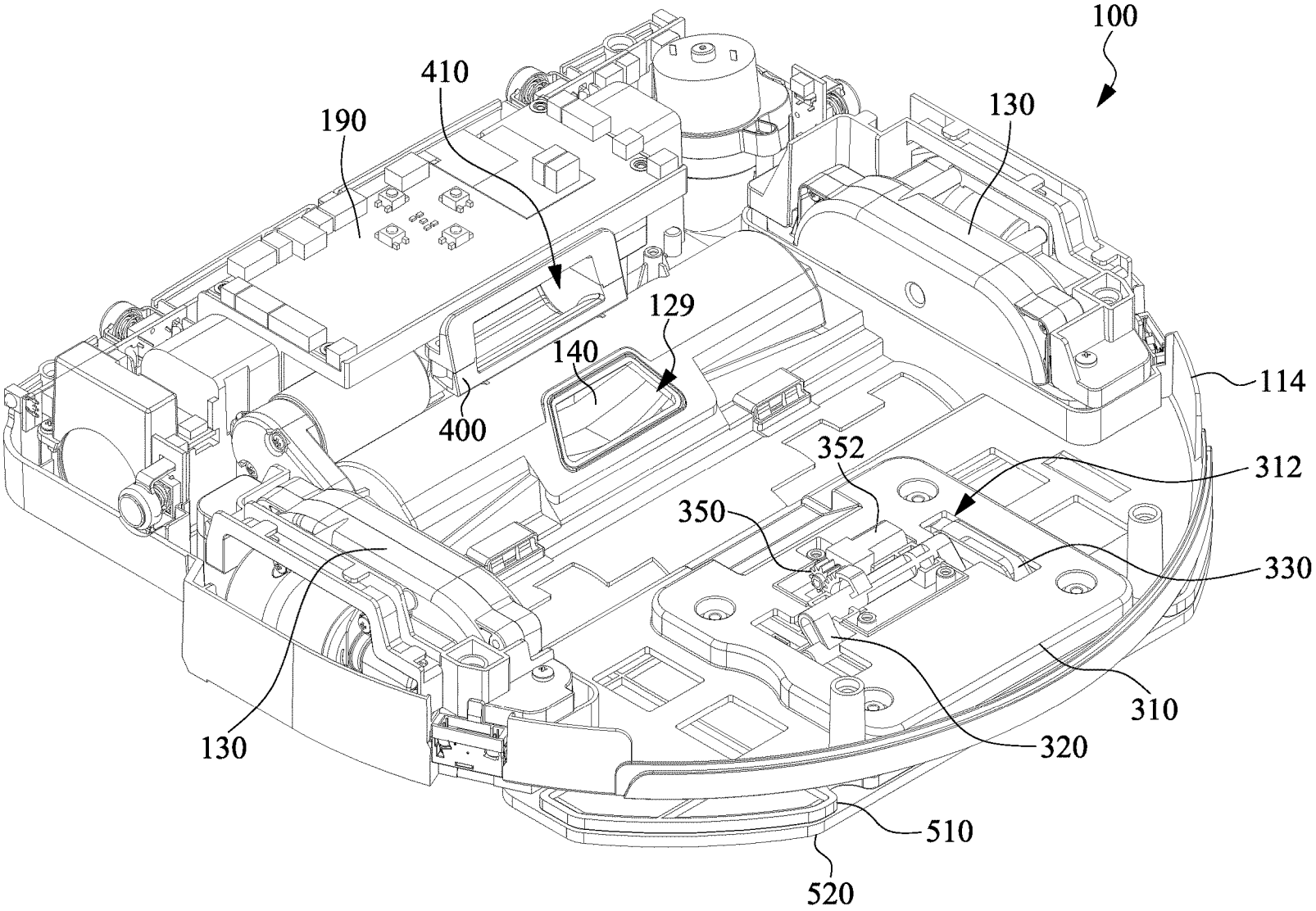
FIG. 5 shows a structure diagram of a base in accordance with some embodiments of the present disclosure.

FIGS. 1 and 2A show three-dimensional views from different perspectives of the self-moving cleaning device 100 in accordance with some embodiments of the present disclosure. FIG. 2B shows a bottom view of the self-moving cleaning device 100 in accordance with some embodiments of the present disclosure. FIG. 4 shows an exploded view of the self-moving cleaning device 100 in accordance with some embodiments of the present disclosure. FIG. 5 shows a structure diagram of a base in accordance with some embodiments of the present disclosure. The work principle of the self-moving cleaning device 100 in the present disclosure is best understood from the following detailed description when read with the above figures.

Referring to FIG. 1, the self-moving cleaning device 100 includes a bumper 120, a case 112 and an upper cover 102. In some embodiments, the self-moving cleaning device 100 further includes an operation panel 104 that may provide a user with an option to select an operation mode by touch or pressing, as shown in FIG. 1. The self-moving cleaning device 100 may travel freely in different directions on a surface to be cleaned. For convenience of description, the self-moving cleaning device 100 is described herein as having a forward-moving direction F and a backward-moving direction B. The bumper 120 has a flat shape and faces the forward-moving direction F, wherein the bumper 120 forms a front side of the self-moving cleaning device 100. The case 112 has a curved shape and faces the backward-moving direction B, wherein the case 112 forms a back side of the self-moving cleaning device 100. However, the present disclosure is not limited to the shapes of the bumper 120 and the case 112.

FIG. 2A shows a three-dimensional view from another perspective of the self-moving cleaning device 100 in accordance with some embodiments of the present disclosure, and FIG. 2B shows a bottom view of the self-moving cleaning device 100 in accordance with some embodiments of the present disclosure. Referring to FIGS. 2A and 2B, the self-moving cleaning device 100 further includes various components, such as a first suction port 122, a second suction port 124, a mobile module 130, a front wheel 132, a roller brush device 140, a side brush device 150, and a spray module 160. The aforementioned components are attached to a base 114 and extend or are exposed from a lower side of the base 114. As described herein, for the convenience of description, the base 114 has an upper side and the lower side, and these sides refer to orientations of the self-moving cleaning device 100 when it is placed on the surface to be cleaned, wherein the upper side refers to a side facing away from the surface to be cleaned, and the lower side refers to a side facing the surface to be cleaned. In one embodiment, the self-moving cleaning device 100 further includes a battery module 170 attached to the base 114.

The mobile module 130 is adjacent to the base 114, disposed on opposite sides of the base 114, exposed through the lower side of the base 114, and disposed in a middle portion of the base 114, allowing the self-moving cleaning device 100 to contact the surface to be cleaned while the self-moving cleaning device 100 moves on the surface. As shown in FIG. 2B, the mobile module 130 may include a pair of mobile components and a main driving device, wherein the mobile components may be moving parts such as pulleys and rollers, and the main driving device may be a combination of a motor, a gear and other transmission devices. The mobile components are driven by the main driving device to move the self-moving cleaning device 100 forward, backward, or turning on the surface to be cleaned. In the present embodiment, each of the mobile components of the mobile module is configured as pulleys, which include caterpillar tracks and two driving wheels for driving the caterpillar tracks.

The front wheel 132 is disposed in the front region of the self-moving cleaning device 100, and is closer to the front side of the self-moving cleaning device 100 than the mobile module 130. In some embodiments, the front wheel 132 is used as an auxiliary wheel of the mobile module 130; while the mobile module 130 drives the self-moving cleaning device 100 to travel, the front wheel 132 helps maintain balance, and thus the front wheel 132 is not required to drive the self-moving cleaning device 100.

Referring to FIG. 4, the self-moving cleaning device 100 further includes a dust box 200 and a vacuum module 180 disposed within the case 112 above the base 114. The vacuum module 180 is connected to the first suction port 122 and the second suction port 124 through the dust box 200. In one embodiment, the vacuum module 180 includes a pump. During operation, the air in the first suction port 122 and the second suction port 124 is sucked away by the vacuum module 180, so that a negative pressure is formed inside the first suction port 122 and the second suction port 124, thereby generating a suction force.

In one embodiment, the spray module 160 is disposed on the base 114, and may spray water or other cleaning liquid to wet the surface to be cleaned, such that dirt adhered to the surface may be more easily removed, thereby improving a cleaning effect of the self-moving cleaning device 100. In one embodiment, the self-moving cleaning device 100 includes a water supply module, which may consist of a water tank, a pump, and a supply pipe, wherein the water tank is filled with water or cleaning liquid that is transported to the spray module 160 through the supply pipe, and the pump is used to pressurize the water or cleaning liquid in the supply pipe. In one embodiment, the nozzle of the spray module can extend from the lower side of the base 114 to the surface to be cleaned. In one embodiment, the spray module 160 includes an outlet, e.g., the nozzle, that may control a direction of the spray module 160 by adjusting a direction of the outlet, and that sprays water or cleaning liquid from both sides of the base 114 toward the middle portion of the base, so that the water or cleaning liquid may be more effectively used with the cloth.

The base 114 is provided with the first suction port 122. In one embodiment, the first suction port 122 has a first vacuum channel formed of a frame and a plurality of side walls made from the base 114, and extends from the lower side of the base 114 to the upper side of the base 114. The first vacuum channel includes a first suction inlet 123 disposed on the lower side of the base 114. As shown in FIGS. 2A and 2B, the first suction port 122 has a pair of symmetrical wall surfaces 122A, a pair of symmetrical wall surfaces 122B, and a pair of symmetrical wall surfaces 122C on the lower side of the base 114, in which these wall surfaces define the first suction inlet 123 along both sides of the first suction port 122. The wall surfaces 122A may have flat surfaces, and the wall surfaces 122B and 122C may have curved surfaces, wherein the curvature of the curved surfaces of the wall surfaces 122C is greater than the curvature of the curved surface of the wall surfaces 122B. This causes the first vacuum channel of the first suction inlet 123 to occupy a larger area of the lower side of the base 114, wherein an area of the first vacuum channel is gradually reduced toward the upper side of the base 114, so that a greater amount of dust or debris may be picked up through the lower side of the base 114.

In one embodiment, the first suction port 122 draws dust or dirt off the surface to be cleaned, into the first suction inlet 123 and into the dust box 200 by help of the negative pressure provided by the vacuum module 180. In one embodiment, there are no cleaning elements such as bristles or brush blades provided for the first suction port 122 or the first suction inlet 123, and as a result, any debris having an elongated shape, such as string, human hair or pet hair, will not get stuck in the first vacuum channel or the first suction inlet 123. Therefore, there is no need to clean the first suction port 122 regularly, which reduces time spent maintaining and operating the self-moving cleaning device 100.

The base 114 is further provided with the second suction port 124. In one embodiment, the second suction port 124 includes a second vacuum channel formed of a frame and a plurality of side walls formed in the base 114. The second vacuum channel includes a second suction inlet 125 disposed on the lower side of the base 114 and adjacent to the first suction inlet 123. In one embodiment, a distance between the second suction inlet 125 and the first suction inlet 123 is equal to or less than about 30 mm, and preferably less than about 25, 20, 15, 12, 10 or 5 mm. If the distance between the second suction inlet 125 and the first suction inlet 123 exceeds about 30 mm, the probability of lighter elongated debris entering the second suction port 124 and becoming tangled on the roller brush is greatly increased. When the distance is less than about 5 mm, the difficulty of manufacturing the self-moving cleaning device 100 greatly increases due to stricter tolerances. In one embodiment, the distance between the second suction inlet 125 and the first suction inlet 123 is between any two of the aforementioned values, based on a balance between an effectiveness of picking up lighter elongated debris and a convenience of manufacture and assembly; the distance is preferably between 5 mm and 20 mm, and more preferably between 10 mm and 15 mm. In one embodiment, the roller brush device 140 is disposed on the base 114, surrounded by the second suction port 124 and exposed through the lower side of the base 114. In one embodiment, the second suction port 124 includes a roller brush cover 227 which is disposed on the lower side of the base 114. The roller brush cover 227 may be annular and may allow the second suction inlet 125 to be exposed. The roller brush cover 227 may be opened and closed, so as to allow the roller brush device 140 to be removed from the lower side of the base 114 when the roller brush cover 227 is opened, and to allow the roller brush device 140 to be locked by the roller brush cover 227 on the base 114 within the second suction inlet 125 when the roller brush cover 227 is closed. Such configuration allows the roller brush device 140 to rotate stably without vibrating during a cleaning operation. In one embodiment, an area of the second suction port 124 is greater than an area of the first suction port 122, or a width of the second suction port 124 is greater than a width of the first suction port 122.

Referring to FIGS. 2B and 4, the roller brush device 140 includes a roller brush shaft 142 and a roller brush 144 disposed on the roller brush shaft 142. In one embodiment, the roller brush shaft 142 is rod-shaped, holding ends are disposed on both sides of the rod, and the roller brush shaft 142 is detachably clamped to the base 114. The roller brush shaft 142 may be connected to a roller-brush driving device 146, such as a motor, through a holding end, wherein the roller-brush driving device 146 provides power to rotate the roller brush shaft 142. In one embodiment, the roller brush 144 is made of a flexible material and has a shape of a brush blade or bristles. The roller brush 144 is attached to the roller brush shaft 142 and extends radially outward with the roller brush shaft 142 as the center. In one embodiment, the brush blades of the roller brush 144 extend in a curved or a wave shape. When the self-moving cleaning device 100 travels, the roller brush 144 generates a torque via the rotating of the roller brush shaft 142 by the roller-brush driving device 146, which drives the roller brush 144 to rotate with the roller brush shaft 142 as the axis. Therefore, when the roller brush 144 rotates, its outer end, that is, the position close to the surface to be cleaned, has the largest or nearly the largest tangential velocity, which helps the roller brush 144 to scrape dust or dirt off the surface with a rotary force.

In one embodiment, the second suction port 124 draws dust or dirt off the surface to be cleaned and into the second suction inlet 125 through the negative pressure provided by the vacuum module 180. In one embodiment, since the second suction port 124 includes the roller brush device 140 in the second suction inlet 125, when the surface to be cleaned has sticky dust or heavier debris thereon, the vacuum suction force of the vacuum module 180 and the rotation torque of the roller brush device 140 may be applied at the same time to remove the sticky dust or heavier debris, and any debris that is not completely removed by the first suction port 122 may be drawn by the second suction port 124, thus improving the cleaning effect of the self-moving cleaning device 100.

Figure 3A:
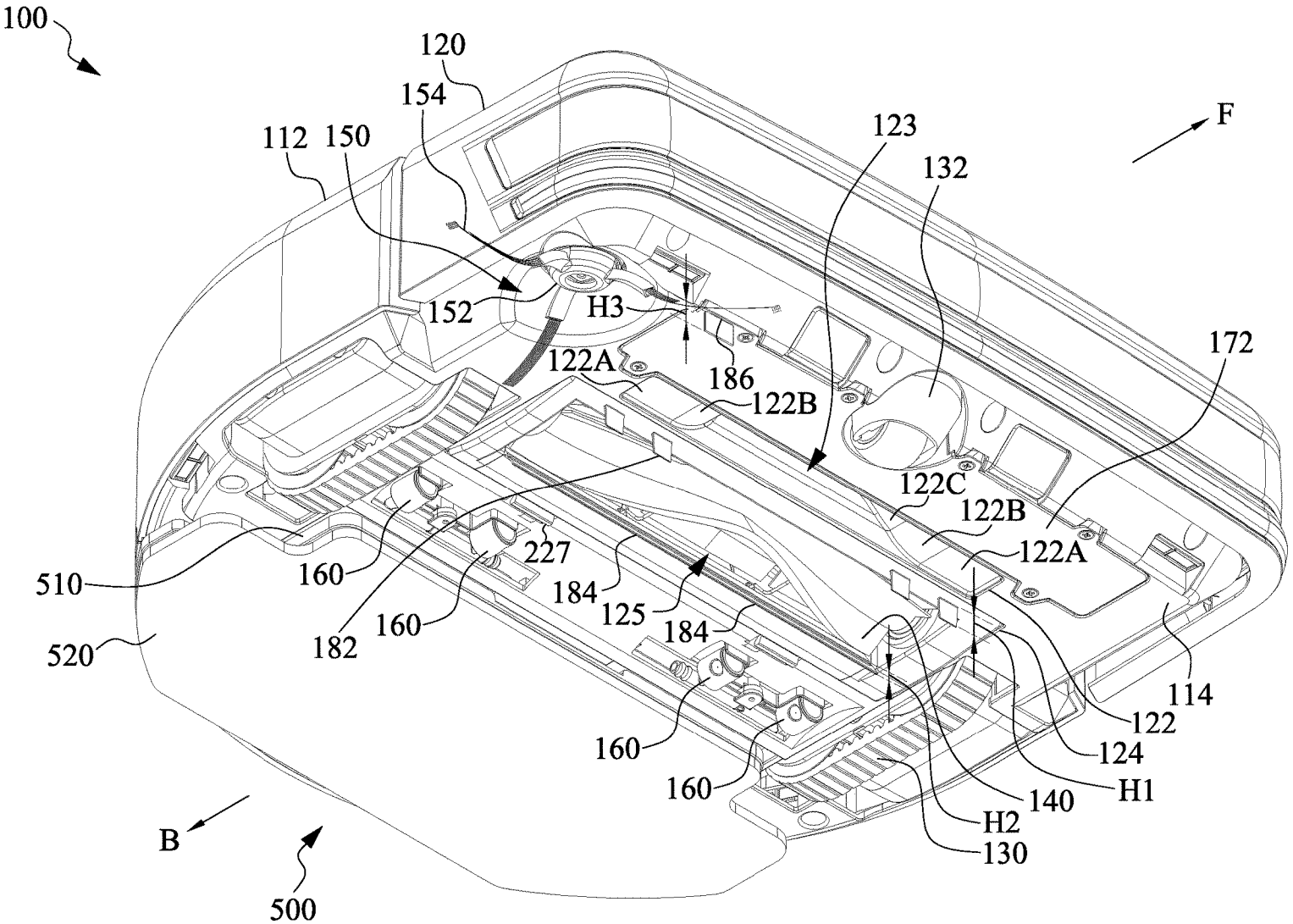
FIGS. 3A and 3B show a three-dimensional view and a bottom view, respectively, of the self-moving cleaning device in accordance with some embodiments of the present disclosure.
Figure 3B:
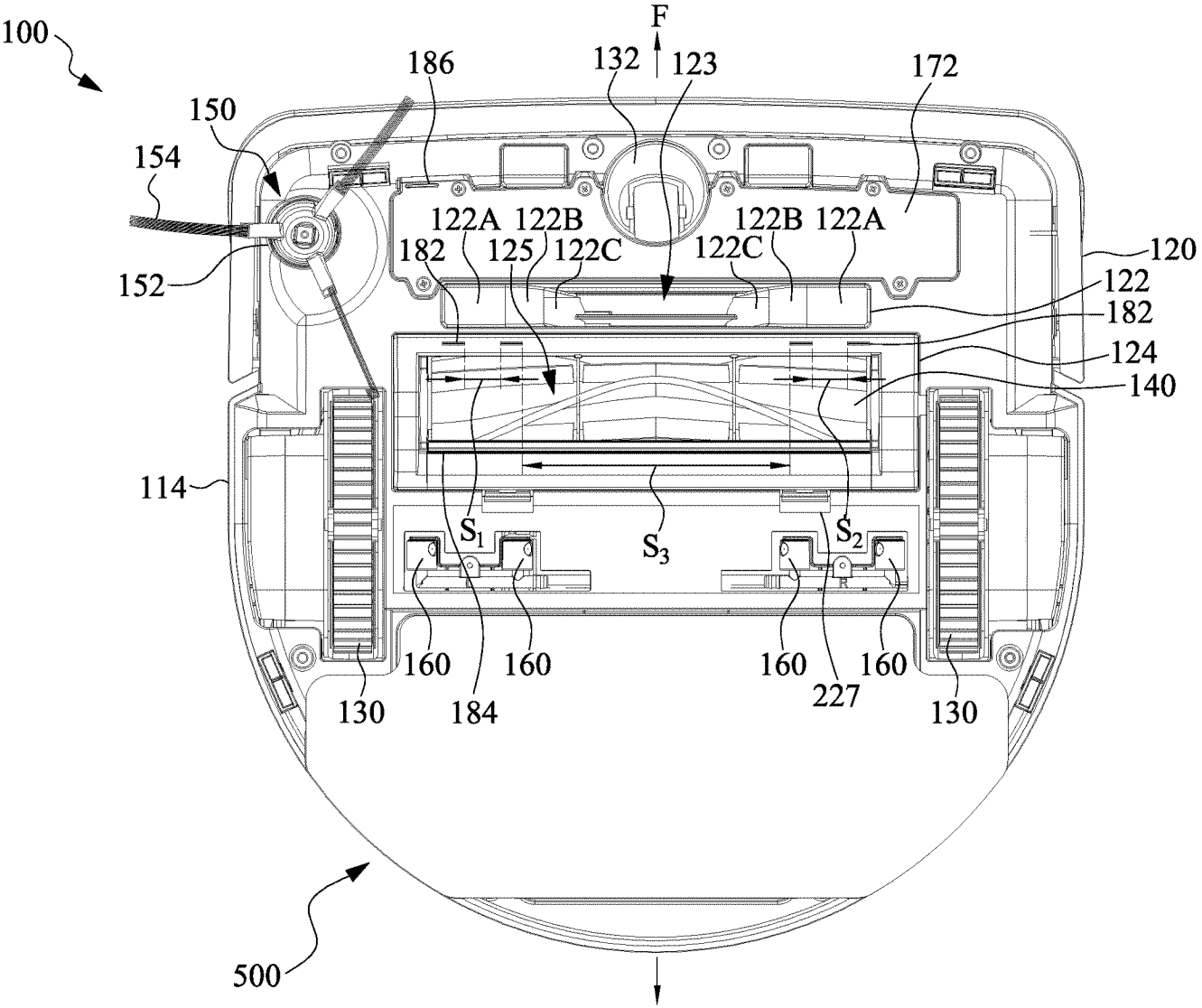
Figure 3C:
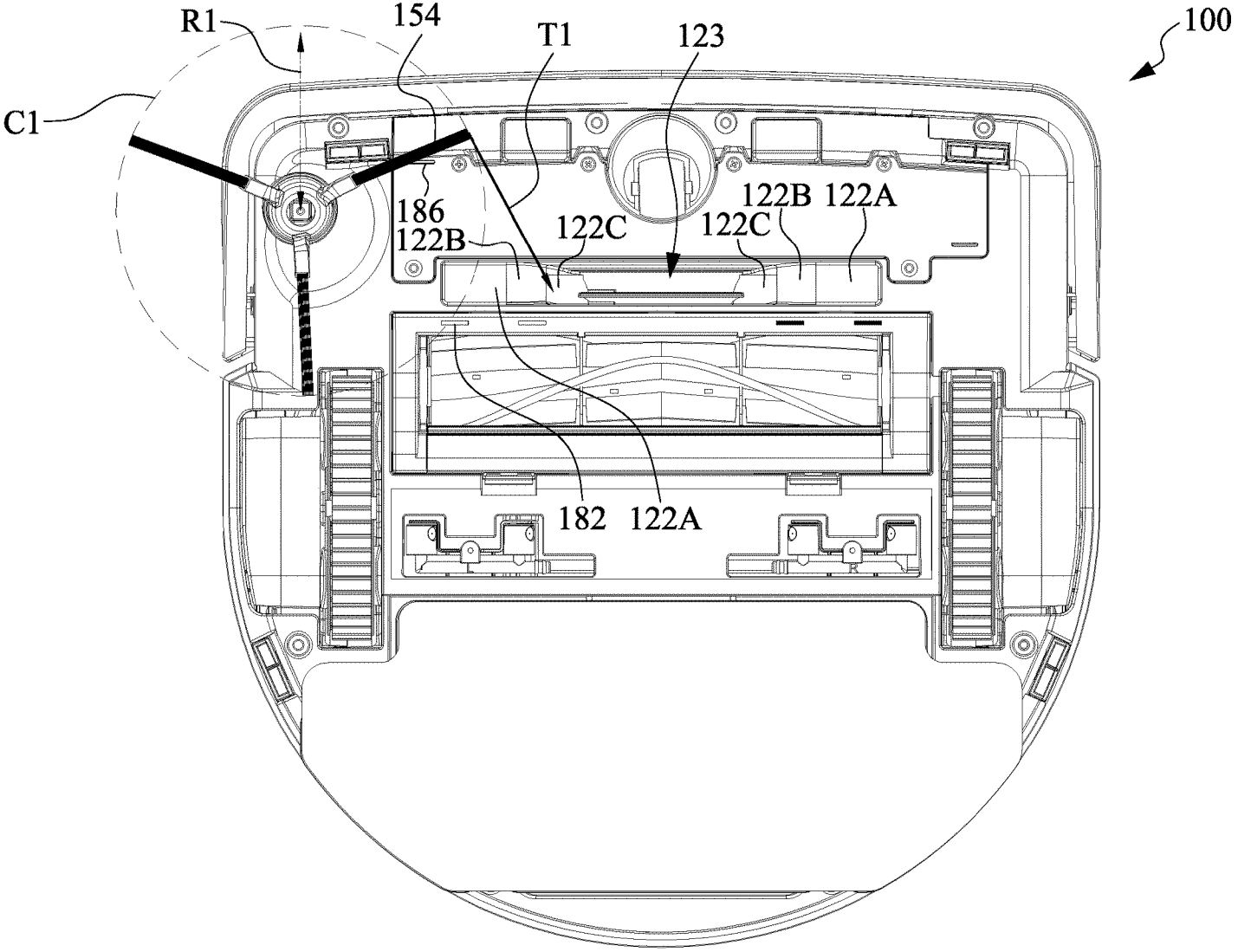
FIG. 3C shows a bottom view of the self-moving cleaning device in accordance with some embodiments of the present disclosure.

Referring to FIGS. 2A, 2B and 4, the side brush device 150 is disposed on the lower side of the base 114. In one embodiment, the side brush device 150 is arranged on the lower side of the base 114 in an asymmetrical manner or a unilateral arrangement. The side brush device 150 may be arranged near any corner close to the front side of the self-moving cleaning device 100, for example, the side brush device 150 may be arranged between the front side of the self-moving cleaning device 100 and the first suction port 122, close to the front side of the self-moving cleaning device 100 or close to the side of the base 114. In one embodiment, the side brush device 150 includes a rotating shaft 152 and bristles 154 disposed on the rotating shaft 152. In one embodiment, the rotating shaft 152 has a disc shape, and a holding end is disposed on a side of the rotating shaft 152 facing the base 114, wherein the holding end is connected to the base 114. The rotating shaft 152 may be connected to a side-brush driving device, e.g., a motor (not shown) through the holding end, and thus is driven to rotate by the side-brush driving device. In one embodiment, the bristles 154 are made of a flexible material and have a long strip shape. A number of bristles 154 may be one or more, e.g., 3, and the present disclosure does not limit the number of bristles 154. Referring to FIG. 3C, the bristles 154 are attached to the rotating shaft 152 and extend radially outward from the rotating shaft 152. A region defined by a circle C1 with the rotating shaft 152 as a center and a length of the bristles 154 as a radius R1 is substantially parallel to the surface to be cleaned. When the self-moving cleaning device 100 travels, the rotating shaft 152 generates a rotational torque that drives the bristles 154 to rotate in a direction parallel to the surface to be cleaned, so that the bristles 154 may contact a maximum area of the surface, thereby improving the cleaning effect of the self-moving cleaning device 100. By the movement of the self-moving cleaning device 100 combined with the sweeping action of the side brush device 150, the dust or dirt on the surface may be swept by the side brush device 150 to be closer to the first suction inlet 123 or the second suction inlet 125, and may be more easily sucked into the first suction inlet 123 or the second suction inlet 125.

Referring to FIGS. 2B and 4, in one embodiment, the self-moving cleaning device 100 includes a battery module 170, and the base 114 further includes a battery cover 172 disposed on the lower side of the base 114. The battery module 170 is installed in the base 114, and the battery cover 172 is used to lock the battery module 170 in the base, and the battery cover 172 can be opened for replacement of the battery module 170.

Figure 6A:
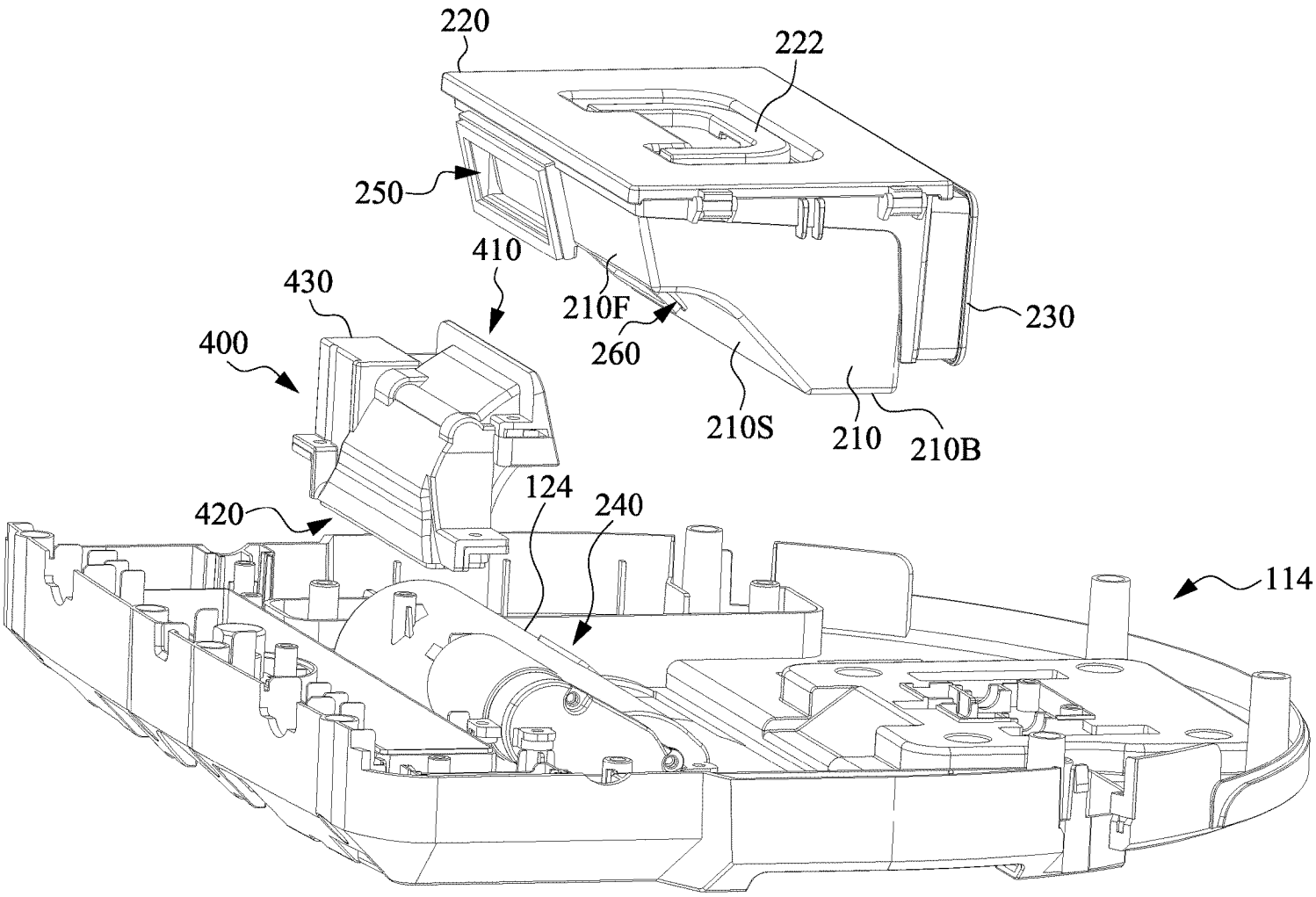
FIGS. 6A and 6B show a three-dimensional exploded view and an assembly diagram, respectively, of the base, an air duct, and a dust box in accordance with some embodiments of the present disclosure.
Figure 6B:
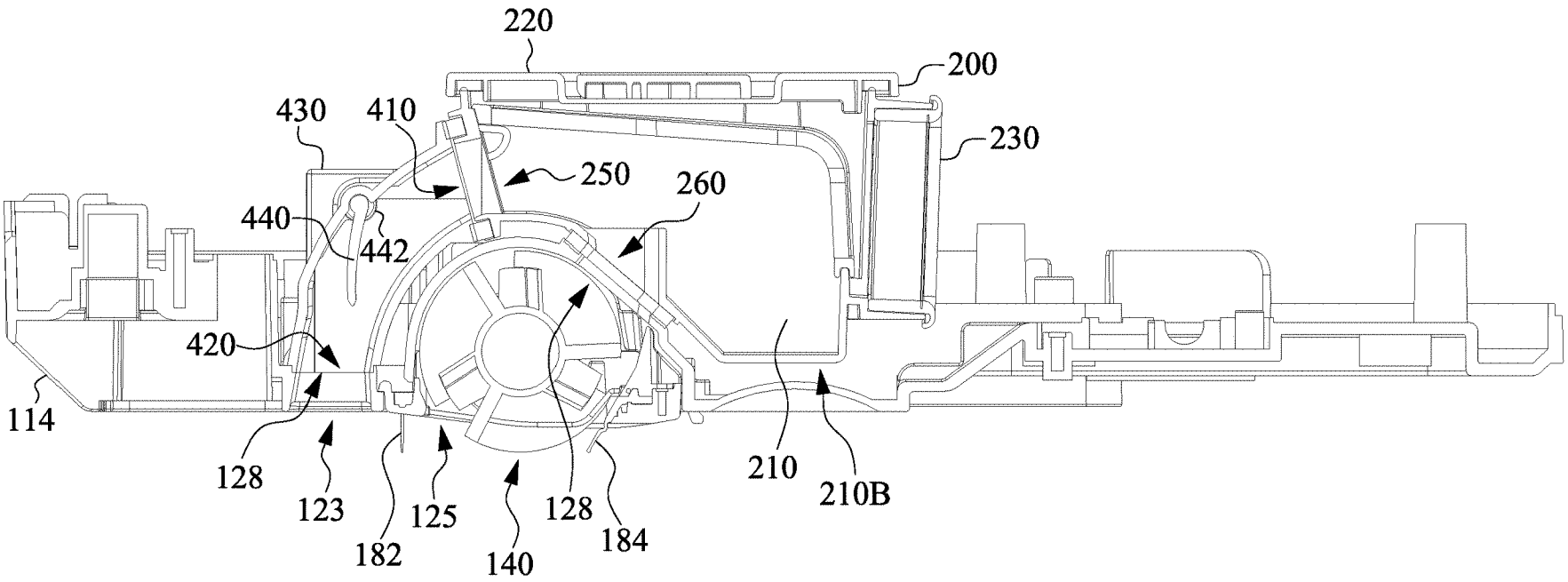

In one embodiment, the side wall of the first suction port 122 extends from the first suction inlet 123 to the upper side of the base 114, and an opening 128 is formed adjacent to the second suction port 124 (see FIG. 6B). The opening 128 and the first suction inlet 123 are disposed on the upper side and the lower side of the base 114, respectively, and serve as two openings of the first suction port 122. In one embodiment, the side wall of the second suction port 124 forms a roller-brush accommodating space on the upper side of the base 114 to accommodate the roller brush device 140. In one embodiment, the roller-brush accommodating space has a cylindrical shape, but the present disclosure does not limit the shape of the roller-brush accommodating space of the second suction port 124, and other shapes may also be within the contemplated scope of the present disclosure. The side wall of the second suction port 124 forms an opening 129 on the upper side of the roller-brush accommodating space. As shown in FIGS. 2B and 5, the opening 129 and the second suction inlet 125 are disposed on the upper and lower sides of the base 114, respectively, and serve as two openings of the second suction port 124, wherein the roller brush device 140 is disposed between the second suction inlet 125 and the opening 129.

Referring to FIG. 4, the dust box 200 is disposed in a dust-box accommodating space formed within the case 112. The self-moving cleaning device 100 further includes an air duct 400 disposed between the case 112 and the base 114. Referring to FIGS. 6A and 6B, the dust box 200, the air duct 400, and the base 114 are connected in sequence after assembly. The air duct 400 has side walls to form an upper opening 410 and a lower opening 420, wherein the lower opening 420 is connected to the opening 128 of the first suction port 122, and the upper opening 410 is connected to the dust box 200. In one embodiment, the wall surface 122C is disposed on the air duct 400 and defines the lower opening 420, and the wall surfaces 122A and 122B are disposed on the base 114, thereby allowing the wall surface 122C to have a larger curvature. In one embodiment, the second suction port 124 has a cylindrical shape, and the air duct 400 includes a curved duct wall, which extends along the side wall (for example, a curved surface) of the second suction port 124, so that the utilization of an internal space of the self-moving cleaning device 100 may be maximized, the volume of the self-moving cleaning device 100 may be reduced, and the length of the first vacuum channel may be reduced, thereby reducing power consumption of the vacuum module 180 and noise of the vacuum module 180. In one embodiment, the duct wall of the air duct 400 and the wall of the second suction port 124 adjacent to the air duct 400 have the same curvature. As mentioned above, due to the curved design of the wall surfaces 122B and 122C, the area of the first suction inlet 123 is greater than the area of the opening 128. In one embodiment, the area of the air duct 400 gradually decreases from the lower opening 420 to the upper opening 410 so that the aperture of the first vacuum channel gradually increases in size from a first opening 250 of the dust box 200 to the first suction inlet 123. In this case, the area of the first suction inlet 123 is greater than the area of the opening 128 and the area of the lower opening 420, and the area of the lower opening 420 is greater than the area of the upper opening 410, so that the first vacuum channel has a gradually decreasing area.

Referring to FIG. 6B, in one embodiment, the air duct 400 includes a choke valve 440, which may be controlled by a choke-valve driving device, such as a motor 430, to open or close. The choke valve 440 may be rotated by the choke-valve driving device (such as the motor 430), wherein the choke valve 440 is pivoted around the pivot 442, and when the choke valve 440 is opened, the air duct 400 may keep unobstructed so that airflow enters the dust box 200 through the air duct 400. When the choke valve 440 is closed and abuts against a lower pipe wall of the air duct 400, the air duct 400 is closed to close the first vacuum channel, thereby blocking the airflow from entering the dust box 200 through the air duct 400. In a normal mode, the choke valve 440 is opened to keep the first vacuum channel clear. In another embodiment, when a user decides to use a power-saving mode or a silent mode of the self-moving cleaning device 100, the first vacuum channel may be closed. Most or all of the suction force generated by the vacuum module 180 is concentrated in the second vacuum channel, so the power consumption and noise of the vacuum module 180 may be reduced, so as to achieve the purpose of a power-saving and quiet operation. In one embodiment, when the user determines that there is no elongated debris on the surface to be cleaned, the user may choose to close the first vacuum channel in order to increase the suction force of the second vacuum channel, thereby speeding up the cleaning process.

Figure 7A:
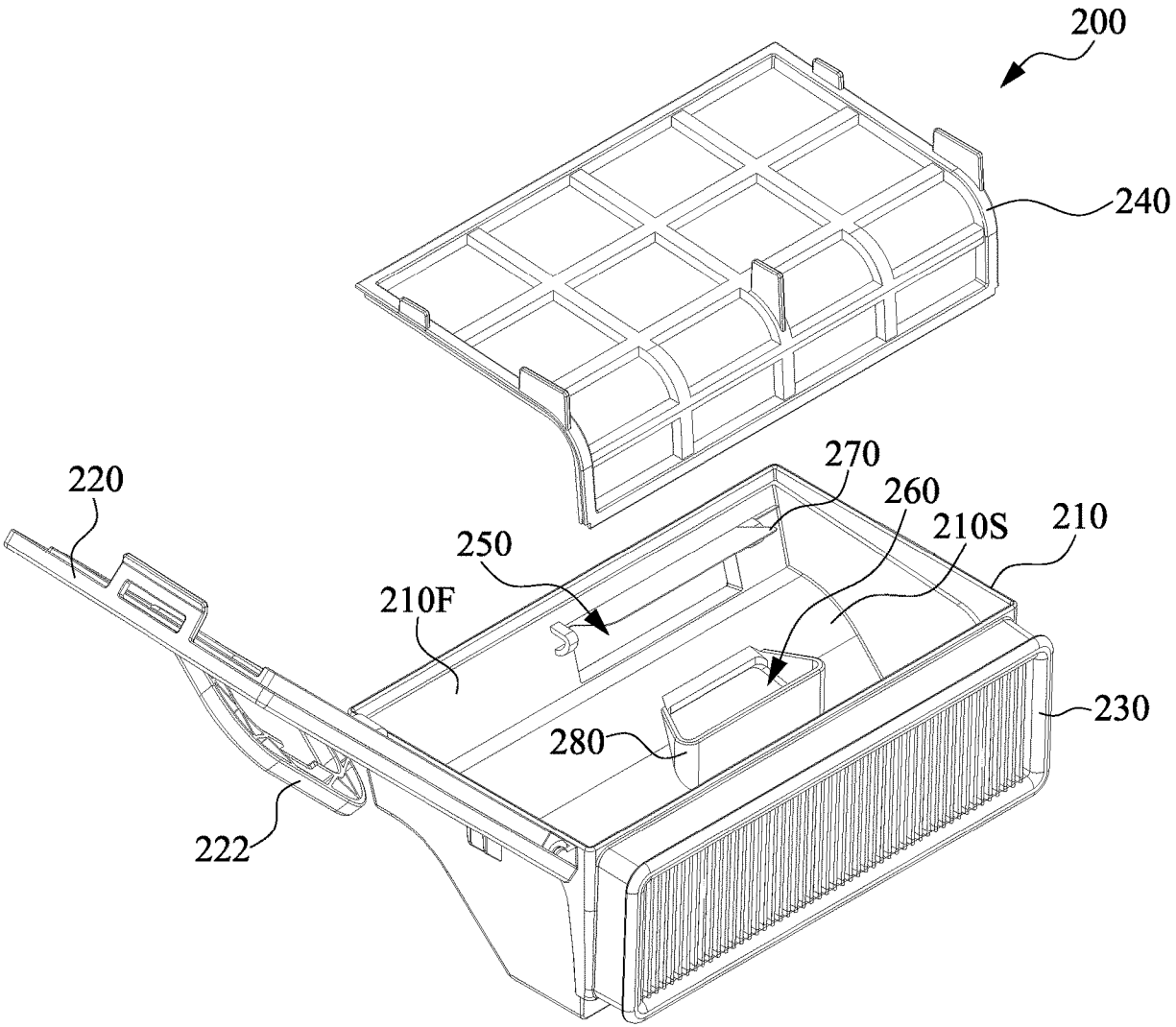
FIGS. 7A, 7B and 7C show a three-dimensional exploded view, a front view and a side view, respectively, of the dust box in accordance with some embodiments of the present disclosure.

FIG. 7A shows a three-dimensional exploded view of a dust box in accordance with some embodiments of the present disclosure. Referring to FIG. 7A, the dust box 200 includes a body 210, an upper cover 220, a handle 222, a filtering section 230, and a filter 240. In one embodiment, the upper cover 220 is designed to be opened and closed, and the body 210 includes a pivot on an upper edge of one side, so that the upper cover 220 is pivotally connected to the body 210 through the pivot. The upper cover 220 may be tightly attached to the body 210 when the upper cover 220 is closed to prevent collected dust and debris from falling out of the dust box 200. The dust and debris collected by the dust box 200 may be poured out when the upper cover 220 is open. The handle 222 on the upper cover 220 allows the user to remove the dust box 200 from the case 112 in order to pour out the dust and debris from the dust box 200.

In one embodiment, the body 210 of the dust box 200 has a quadrangular shape, which corresponds to the shape of the upper cover 220. However, in other embodiments, the body 210 of the dust box 200 may have other shapes. In the embodiment where the body 210 is quadrilateral, the body 210 has at least four sides, such as a front side, which has a front side wall 210F (for example, on the front side of the body 210 facing the air duct 400), a rear side, to which the filtering section 230 is attached, and a left side and a right side, which have a left side wall and a right side wall, respectively, for connecting the front side wall 210F and the filtering section 230. The body 210 further includes a fifth side wall 210S between the front side wall 210F and a bottom surface 210B, which has an inclined surface, wherein an area of the front side wall 210F is less than an area of the rear side. In one embodiment, due to the inclined surface of the fifth side wall 210S, each of the left side wall and the right side wall has a narrow front, a wide rear, a narrow bottom and wide top.

Figure 7B:
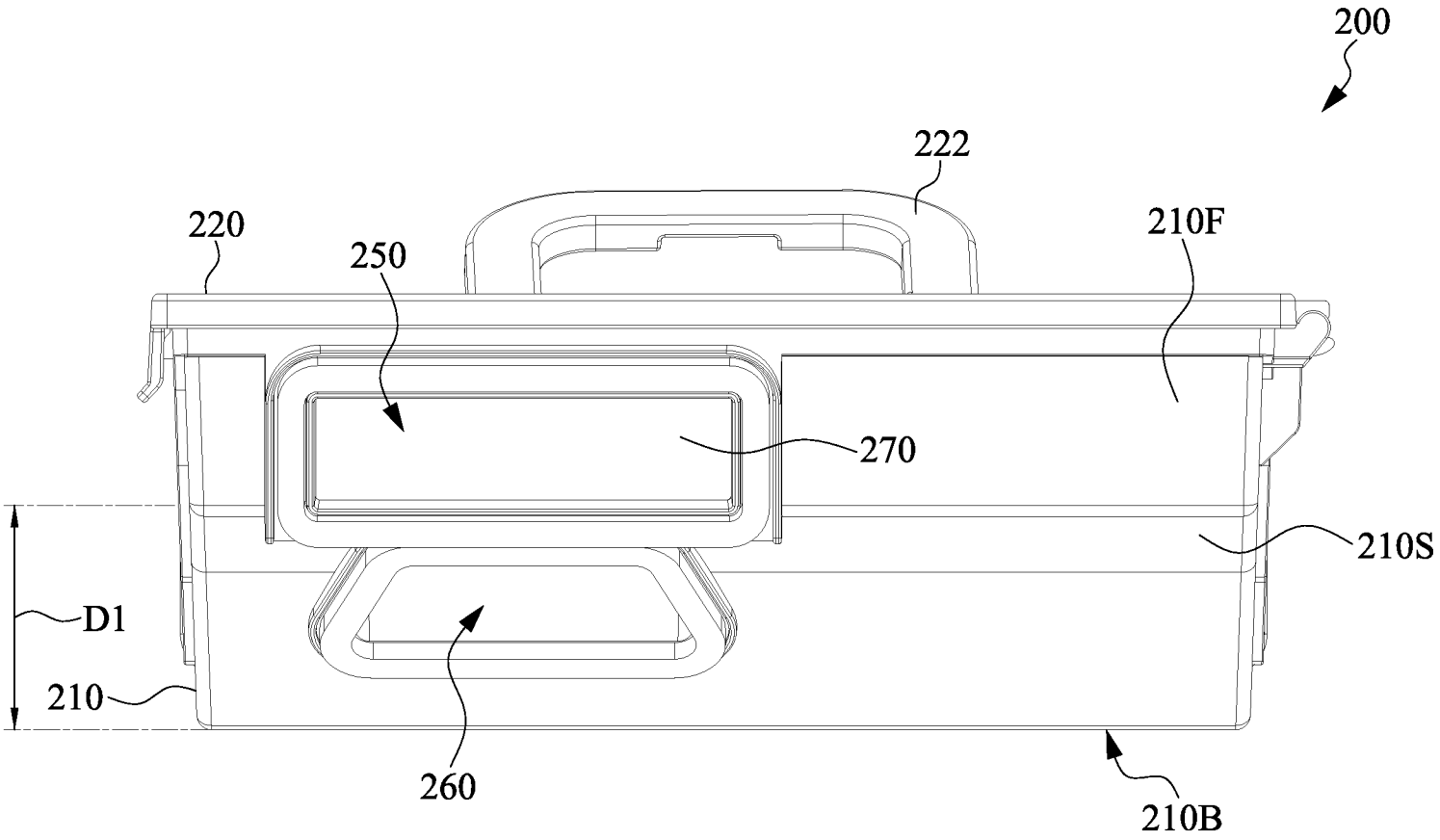
Figure 7C:
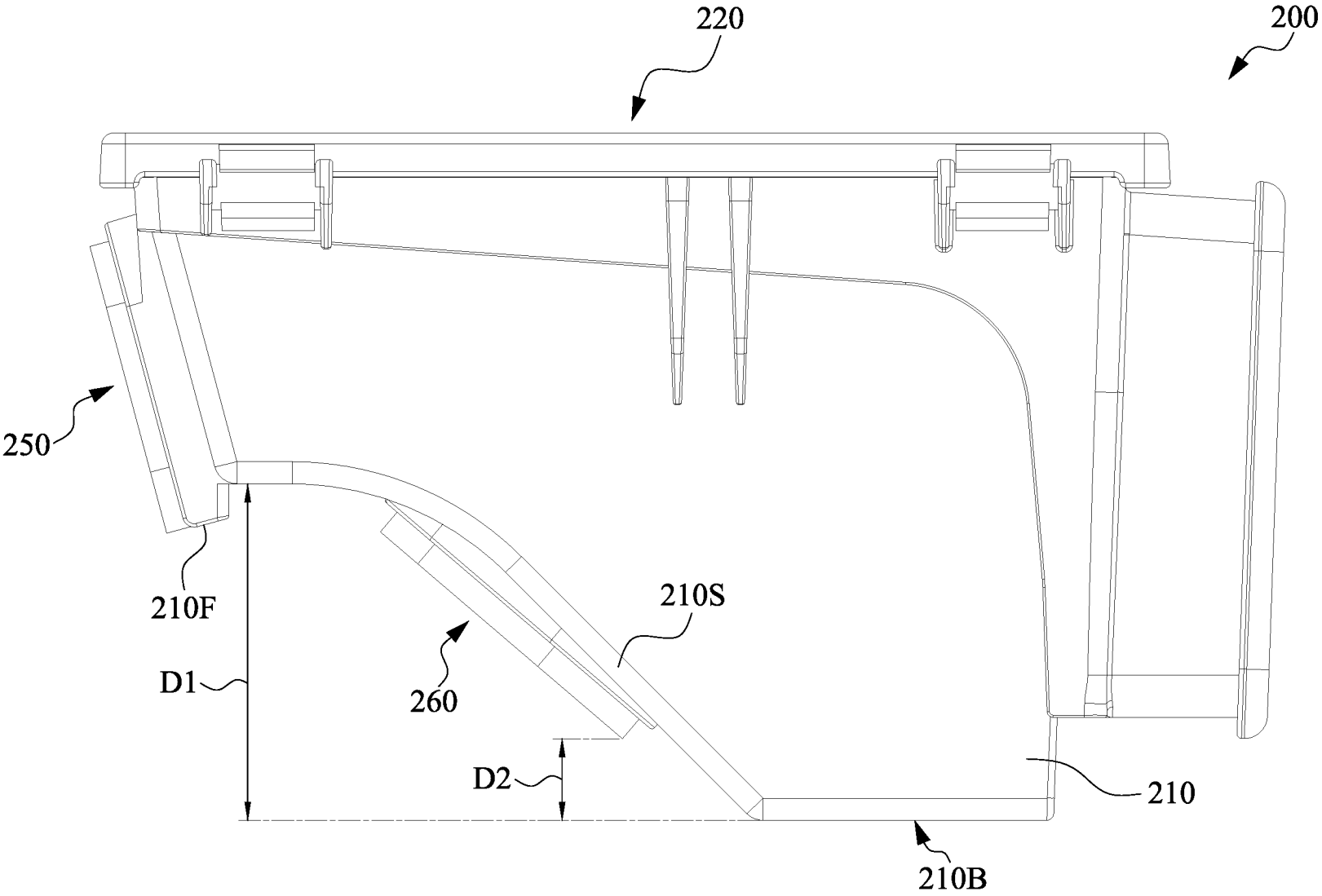

Referring to FIGS. 7B and 7C, the body 210 includes a first opening 250 and a second opening 260, wherein the first opening 250 is disposed on the front side wall 210F, and the second opening 260 is disposed on the fifth side wall 210S, so that the first opening 250 is disposed above the second opening 260. A distance between the front side wall 210F or the first opening 250 and the bottom surface 210B is approximately equal to a distance D1, and a distance between the second opening 260 and the bottom surface 210B is equal to a distance D2. Referring to FIG. 7A, the body 210 includes an opening cover 270 at the first opening 250, which is closed when there is no air flow through the first opening 250, so as to ensure that the dust and debris in the dust box 200 do not fall out. Similarly, the body 210 includes a side wall 280 near the second opening 260 as a barrier wall to surround the second opening 260 from the inside, and the second opening 260 is higher than the bottom surface 210B by the distance D2, so that the side wall 280 and the bottom surface 210B form a debris-accommodating space, which increases the volume of the dust box 200 for accommodating debris.

As mentioned above, the surface to be cleaned in an ordinary home or office often has, in addition to dust and dirt, elongated debris, such as string, human hair or pet hair, scattered thereon. Such elongated debris tends to be lightweight and is usually not sticky, but is also not easy to clean because it can easily become entangled in the brush blades or bristles of a conventional vacuum cleaning device. However, the brush blades and bristles also have advantages for cleaning. As mentioned above, although the dust and dirt stuck on the surface to be cleaned may be effectively removed by the rotation of the brush blades or the bristles, such dust and dirt may not be so easily cleared if it is cleaned only by vacuum, and effective cleaning may require additional vacuum force, wherein the excess power consumed would reduce efficiency of the cleaning device. In addition, such a vacuum module may also generate greater noise when generating greater vacuum force, which would greatly reduce the user convenience of the cleaning device.

Referring to FIGS. 2B, 5, 6A and 6B, the self-moving cleaning device 100 of the present disclosure includes double vacuum channels formed by the first vacuum channel and the second vacuum channel Initially, the opening 128 through the first suction port 122 connects to the lower opening 420 of the air duct 400, and then the first opening 250 of the dust box 200 connects to the upper opening 410 of the air duct 400, to constitute the first vacuum channel, which allows the sucked dust and elongated, lightweight debris to enter the dust box 200 through the first suction inlet 123 by help of the suction force generated by the vacuum module 180. In one embodiment, the air duct 400 is free of any roller device, brush device or other similar elements, so elongated debris, such as human hair, string or pet hair, will not get stuck in the air duct 400. Therefore, there is no need to clean the first suction port 122 or the air duct 400 regularly, thereby reducing time spent maintaining and operating the self-moving cleaning device 100.

Also, the opening 129 through the second suction port 124 connects to the second opening 260 of the dust box 200, to constitute the second vacuum channel, which allows the sucked dust and heavier debris to enter the dust box 200 through the second suction inlet 125 by help of the suction force generated by the vacuum module 180. In one embodiment, the roller brush device 140 is arranged in the second vacuum channel, and may be used to scrape, sweep up and push dust that is stuck to the surface, or dust that is heavier and more difficult to remove. In addition, since the first vacuum channel has already cleaned the elongated debris, the probability of the elongated debris being sucked into the second suction port 124 through the second vacuum channel is greatly reduced, thus greatly reducing the possibility of the elongated debris becoming tangled in the roller brush device 140. The need for the user to clean the hair or string from the roller brush device 140 is also greatly reduced, thus improving the convenience and cleaning efficiency of the self-moving cleaning device 100, and reducing maintenance costs.

In one embodiment, the dust box 200 includes a first opening 250 and a second opening 260 to connect to the first vacuum channel and the second vacuum channel aforementioned, respectively. In other words, the first vacuum channel and the second vacuum channel share the dust box 200, which further reduces the volume of the self-moving cleaning device 100. As mentioned above, the first vacuum channel and the second vacuum channel target different types of dust and debris, so the suction force distributed to the first vacuum channel and the second vacuum channel can be different, thereby helping to achieve the dual goal of power savings and effective cleaning at the same time. In one embodiment, the first opening 250 and the second opening 260 of the dust box 200 have different areas, so that the corresponding negative pressures of the first vacuum channel and the second vacuum channel are different. For example, the negative pressure required by the first vacuum channel is relatively small, since the negative pressure of the first vacuum channel needs only to be enough to suck up light and elongated debris, such as hair, while the negative pressure required by the second vacuum channel is relatively large because it needs to suck up heavier debris. Therefore, the same negative pressure generated by the vacuum module 180 is distributed between the first opening 250, which has a greater area, and the second opening 260, which has a smaller area. In one embodiment, the first opening 250 is disposed above the second opening 260, the first opening 250 is connected to the first suction port 122, and the second opening 260 is connected to the second suction port 124; such configuration allows the first vacuum channel to have a longer air duct length than the second vacuum channel Since the debris collected by the first vacuum channel is lighter, the cleaning efficiency of the first vacuum channel and the second vacuum channel may be balanced by the difference in air duct length described above. There is no partition wall in the dust box 200 to separate the first opening 250 from the second opening 260, so that lighter debris and heavier debris are collected in the same space defined by the dust box 200.

FIGS. 7B and 7C show a front view and a side view, respectively, of the dust box 200 in accordance with some embodiments of the present disclosure. Referring to FIG. 7B, in one embodiment, the first opening 250 has a rectangular shape, however, the first opening 250 may have other shapes. In one embodiment, the second opening 260 has a trapezoidal shape, however, the second opening 260 may have other shapes. Referring to FIG. 7C, viewed from the side of the dust box 200, since each of the left side wall and the right side wall of the body 210 has a wide top and a narrow bottom, the first opening 250 protrudes a greater distance forward as compared to the second opening 260. In one embodiment, when viewed from the front, the first opening 250 and the second opening 260 overlap in a vertical direction, whereas when viewed from the side, the first opening 250 and the second opening 260 do not overlap in the vertical direction. In one embodiment, an included angle formed by the first opening 250 and the bottom surface 210B of the dust box 200 is a first acute angle, and an included angle formed by the second opening 260 and the bottom surface 210B of the dust box 200 is a second acute angle, wherein the first acute angle is greater than the second acute angle. In one embodiment, the first opening 250 and the second opening 260 are disposed on a side opposite to the filtering section 230, the first opening 250 protrudes farther forward than the second opening 260, the first opening 250 is closer to the upper side compared to the second opening 260, the second opening 260 is disposed on the fifth side wall 210S of the inclined surface, and the shape of the fifth side wall 210S corresponds to the wall of the air duct 400 and conforms to the shape of the side wall of the second suction port 124. Thus, the aforementioned elements of the self-moving cleaning device 100 are configured in a relatively compact arrangement.

Referring to FIGS. 2A and 2B, in one embodiment, the self-moving cleaning device 100 includes one or more first blocking sheets 182, disposed on the lower side of the base 114, wherein the first blocking sheets 182 are disposed between the first suction port 122 and the second suction port 124. In one embodiment, the first blocking sheets 182 are disposed on the roller brush cover 227. The first blocking sheets 182 may be made of a flexible material, such as resin, plastic, etc. Referring to FIG. 2A, the first blocking sheets 182 are erected from the base 114 and extends toward the surface to be cleaned. The first blocking sheets 182 have a height H1 that is equal to or greater than the vertical distance between the second suction port 124 and the surface to be cleaned, so that when the self-moving cleaning device 100 travels on the surface to be cleaned, the first blocking sheets 182 may contact the surface. In one embodiment, the first blocking sheets 182 are slightly flexed when they contact the surface to be cleaned, so as to ensure that the first blocking sheets 182 actually contact the surface without hindering movement of the self-moving cleaning device 100.

Referring to FIG. 2B, a plurality of first blocking sheets 182 are arranged in a row in a space between the first suction port 122 and the second suction port 124, leaving a distance between each other. In one embodiment, the first blocking sheets 182 are oriented parallel to a long side of the first suction port 122 or a long side of the second suction port 124, and the plurality of first blocking sheets 182 are arranged in a row along a direction parallel to the long side of the first suction port 122 or the long side of the second suction port 124. A number of the first blocking sheets 182 may be one or more, and the present disclosure does not limit the number of the first blocking sheets 182.

The first blocking sheets 182 may be used to block a piece of elongated debris that passes near the first suction port 122 without being completely sucked into the first suction inlet 123, causing the other end of the piece of elongated debris (for example, the other end of a strand of hair) to be sucked into the second suction inlet 125. Since the negative pressure of the second vacuum channel is greater than the negative pressure of the first vacuum channel, when the elongated debris is sucked into both the first suction inlet 123 and the second suction inlet 125 at the same time, it may be possible that the elongated debris eventually gets stuck between the first suction port 122 and the second suction port 124, or may be sucked by the second suction port 124. In order to prevent the elongated debris from being sucked into the first suction inlet 123 and the second suction inlet 125 at the same time, the first blocking sheets 182 may effectively prevent the elongated debris from entering the second suction port 124. Meanwhile, because of the distance between adjacent pairs of the first blocking sheets 182, if smaller particles of dust or granular debris is not picked up by the first suction port 122, the smaller particles may still reach the second suction port 124 through a gap between the first blocking sheets 182 and be sucked into the second suction port 124.

In one embodiment, as shown in FIGS. 2A and 2B, in order to allow the non-elongated debris to reach the second suction port 124 faster through the first blocking sheets 182, the plurality of first blocking sheets 182 are arranged at unequal intervals. In one embodiment, as shown in FIGS. 3A and 3B, the first blocking sheet 182 faces the wall surface 122A, 122B or 122C of the first suction port 122 only. In one embodiment, as shown in FIGS. 3A and 3B, the first blocking sheet 182 and the first suction inlet 123 do not overlap at all, so that no obstructions are disposed on the front of the first suction inlet 123 and the second suction inlet 125 in a direction parallel to the traveling direction F, so as to improve the cleaning efficiency of the second suction port 124. In such case, since the suction force of the first suction port 122 gradually weakens from a central position to positions beyond the two sides of the long side, the elongated debris near the wall surface 122A of the first suction port 122 is likely to be pulled by the suction forces of the first suction port 122 and the second suction port 124 at the same time, which results in half of the elongated debris being sucked in by the first suction port 122 and another half of the elongated debris being sucked in by the second suction port 124, causing the elongated debris to get stuck on the base 114, or causing the entire elongated debris to be sucked in by the second suction port 124, where it may become entangled on the roller brush device 140. To prevent such problem, the first blocking sheets 182 are arranged near the wall surface 122A, 122B or 122C but not near the first suction inlet 123, and the first blocking sheets 182 may contact the surface to be cleaned, in order to ensure that the elongated debris is blocked by one or more first blocking sheets 182, while still allowing the granular debris to be sucked into the second suction inlet 125 through the gap of the first blocking sheets 182 or from an area near the first suction port 122.

Referring to FIGS. 3A and 3B, in one embodiment, the first blocking sheets 182 are divided into two sets, wherein a first set (for example, including two blocking sheets 182) is disposed on a side close to the side brush device 150, and a second set (for example, including two blocking sheets 182) is disposed on a side away from the side brush device 150. The blocking sheets 182 in the first set have a first spacing 51 between them, and the blocking sheets 182 in the second set have a second spacing S2 between them, wherein the first spacing 51 and the second spacing S2 may be equal or unequal. In one embodiment, the first set and the second set have a third spacing S3, wherein the third spacing S3 is greater than the first spacing 51 and greater than the second spacing S2. Still referring to FIG. 3B, the two wall surfaces 122C are both positioned within an area corresponding to the third spacing S3, and at least part of the blocking sheets 182 on the inner sides of the first set and the second set face toward the wall surface 122B, so that both the lower opening 420 and the upper opening 410 of the air duct 400 are positioned within an area corresponding to the third spacing S3.

Referring to FIGS. 2A, 2B, 3A and 3B, in one embodiment, the self-moving cleaning device 100 includes a second blocking sheet 184 disposed on the lower side of the base 114 and on a side of the second suction port 124 close to the spray module 160. In one embodiment, the second blocking sheet 184 is disposed on a side of the roller brush cover 227 opposite to the first blocking sheets 182. The second blocking sheet 184 may be made of a flexible material, such as resin, plastic, etc. Referring to FIG. 2A, the second blocking sheet 184 is erected from the base 114 and extends toward the surface to be cleaned. The second blocking sheet 184 has a height H2 that is equal to or greater than a vertical distance between the second suction port 124 and the surface to be cleaned, so that the second blocking sheet 184 may contact the surface when the self-moving cleaning device 100 travels on the surface to be cleaned. In one embodiment, the second blocking sheet 184 is slightly flexed when it contacts the surface to be cleaned, so as to ensure that the second blocking sheet 184 actually abuts the surface without hindering the movement of the self-moving cleaning device 100.

Referring to FIG. 2B, the second blocking sheet 184 extends along a direction parallel to a long side of the first suction port 122 or a long side of the second suction port 124. In one embodiment, the second blocking sheet 184 extends from one end of a long side of the second suction inlet 125 to another end of the long side of the second suction inlet 125. The second blocking sheet 184 may be used to block dust or debris that is not initially sucked into the first suction inlet 123 or the second suction inlet 125. Through an indiscriminative blocking design of the second blocking sheet 184, more dust and debris may be sucked into the second suction port 124, and the cleaning effect of the self-moving cleaning device 100 may be improved. In addition, since the second blocking sheet 184 contacts the surface to be cleaned, air will not flow through the second blocking sheet 184 or leak from below the second blocking sheet 184, which may increase the suction force of the second suction port 124 on dust and debris, so as to improve the efficiency of removing the dust and debris.

A length of the second blocking sheet 184 may be equal to or greater than a length of the second suction inlet 125. In one embodiment, the first blocking sheet 182 and the second blocking sheet 184 overlap in the traveling direction F of the self-moving cleaning device 100. In other words, one of the plurality of first blocking sheets 182 closest to the two sides of the second suction port 124 does not extend beyond the two ends of the second blocking sheet 184 when viewed in a direction parallel to the traveling direction F.

Referring to FIGS. 2A, 2B, 3A and 3B, in one embodiment, the self-moving cleaning device 100 includes a third blocking sheet 186 disposed on the lower side of the base 114 and adjacent to the side brush device 150. In one embodiment, the third blocking sheet 186 is disposed at a position adjacent to the side brush device 150 between the front side of the self-moving cleaning device 100 and the first suction port 122. The third blocking sheet 186 may be disposed on or near the battery cover 172. The third blocking sheet 186 may be made of a flexible material, such as resin, plastic, etc. Referring to FIG. 2A, the third blocking sheet 186 is erected from the base 114 and extends toward the surface to be cleaned. The third blocking sheet 186 has a height H3 that is less than, equal to or greater than a vertical distance between the second suction port 124 and the surface to be cleaned, so that when the self-moving cleaning device 100 travels on the surface to be cleaned, the third blocking sheet 186 may or may not contact the surface. Referring to FIG. 3C, in one embodiment, at least one part of the third blocking sheet 186 is disposed within a radius of rotation R1 of the bristles 154, so as to ensure that the bristles 154 hit the third blocking sheet 186 when rotating without hindering rotation of the bristles 154. In one embodiment, the third blocking sheet 186 is disposed completely within the radius of rotation R1 of the bristles 154.

Referring to FIGS. 2B and 3B, the third blocking sheet 186 extends along a direction parallel to the long side of the first suction port 122 or the long side of the second suction port 124. In one embodiment, a length of the third blocking sheet 186 is about 0.5 to about 3 times a length of any one of the first blocking sheets 182. In one embodiment, the length of the third blocking sheet 186 does not exceed a bristle length of the bristles 154. In one embodiment, dust is easily attached to the bristles 154 and accumulates on the bristles 154 due to an electrostatic effect when the side brush device 150 rotates to clean the surface, and thus the cleaning effect of the bristles 154 may be reduced. By arranging the third blocking sheet 186 within the radius of rotation R1 of the bristles 154, after the dust is swept by the bristles 154 along the surface to be cleaned, the dust will be shaken off the bristles 154 as the bristles 154 hit the third blocking sheet 186. Due to such process, and in conjunction with the design of the first suction port 122 adjacent to the side brush device 150, the dust shaken off the bristles 154 may be sucked into the first suction inlet 123, thereby improving the cleaning effect of the self-moving cleaning device 100 and reducing maintenance cost of the side brush device 150.

The bristles 154 rotate to remove dust when the side brush device 150 is in operation. The bristles 154 are bent by striking the third blocking sheet 186, and then the bristles 154 leave the third blocking sheet 186 to be quickly restored to their original straight condition through the elasticity of the bristles 154. Referring to FIG. 3C, in one embodiment, the relative positions of the bristles 154 and the third blocking sheet 186 are configured so that, when the bristles 154 rotate and contact the third blocking sheet 186, an extension line T1 of the bristles 154 in a tangential direction of the circle C1 will pass through the first suction port 122, preferably between the two wall surfaces 122B, and more preferably between the two wall surfaces 122C. According to the aforementioned design, when the debris on the bristles 154 falls off, such debris is likely to enter the first suction port 122. In one embodiment, the relative positions of the bristles 154 and the third blocking sheet 186 are configured so that, during the moment or process of the bristles 154 striking the third blocking sheet 186 and then returning from bent to straight, a long axis of the bristles 154 pointing toward the first suction port 122 may overlap the first suction inlet 123, so that the first suction inlet 123 may provide the best vacuum effect on the debris that has been knocked off the bristles 154 by the third blocking sheet 186.

In one embodiment, referring to FIG. 2B, the battery module 170, the first suction port 122, the second suction port 124, the spray module 160, and the mopping module 500 are sequentially configured from the front side of the self-moving cleaning device 100 to the back side of the self-moving cleaning device 100, wherein the first suction port 122 and the second suction port 124 are disposed in a front half of the base 114, and the spray module 160 and the mopping module 500 are disposed in a back half of the base 114. The front half of the self-moving cleaning device 100 performs a dry cleaning mode, in which the first suction port 122 is used to clean part of the dust, along with lighter and elongated debris, and the second suction port 124 is used to clean remaining dust, along with non-elongated and heavier debris. As a result, any remaining debris or dirt that has not been cleaned may not be able to be ideally removed by the dry cleaning mode or by the negative pressure generated by the vacuum module 180. Therefore, the back half of the self-moving cleaning device 100 may perform a wet cleaning function depending upon requirements. Compared to the dry cleaning mode, the wet cleaning mode is beneficial for cleaning dust and dirt that are likely to adhere to the surface to be cleaned, or dust and debris left by the first suction port 122 and the second suction port 124. In one embodiment, the dry cleaning mode and the wet cleaning mode may be performed independently or in combination.

In one embodiment, the mopping module 500 is disposed on the back half of the self-moving cleaning device 100, for example, on the back side of the spray module 160, so that the spray module 160 may spray the surface to be cleaned, and a last cleaning process is performed by a cloth 520 of the mopping module 500, so that the cleaning effect of the self-moving cleaning device 100 may be optimized. In one embodiment, the mopping module 500 includes a cloth seat 510, which is disposed on the lower side of the base 114 and has a flat surface parallel to the surface to be cleaned. In one embodiment, a side of the cloth seat 510 facing the surface to be cleaned is used to stick or attach the cloth 520 as the cloth 520 cleans the surface while moving along the traveling direction F of the self-moving cleaning device 100. The cloth seat 510 may include a hook and loop attachment, such as Velcro, to attach the cloth 520 to the cloth seat 510 in a detachable manner.

Referring to FIGS. 2A, 2B, and 4, in one embodiment, the mopping module 500 is connected to the base 114 through other elements of the lifting device 300. The cloth seat 510 has a flat surface to be easily stuck or attached to the cloth 520 while cleaning.

Figure 8:
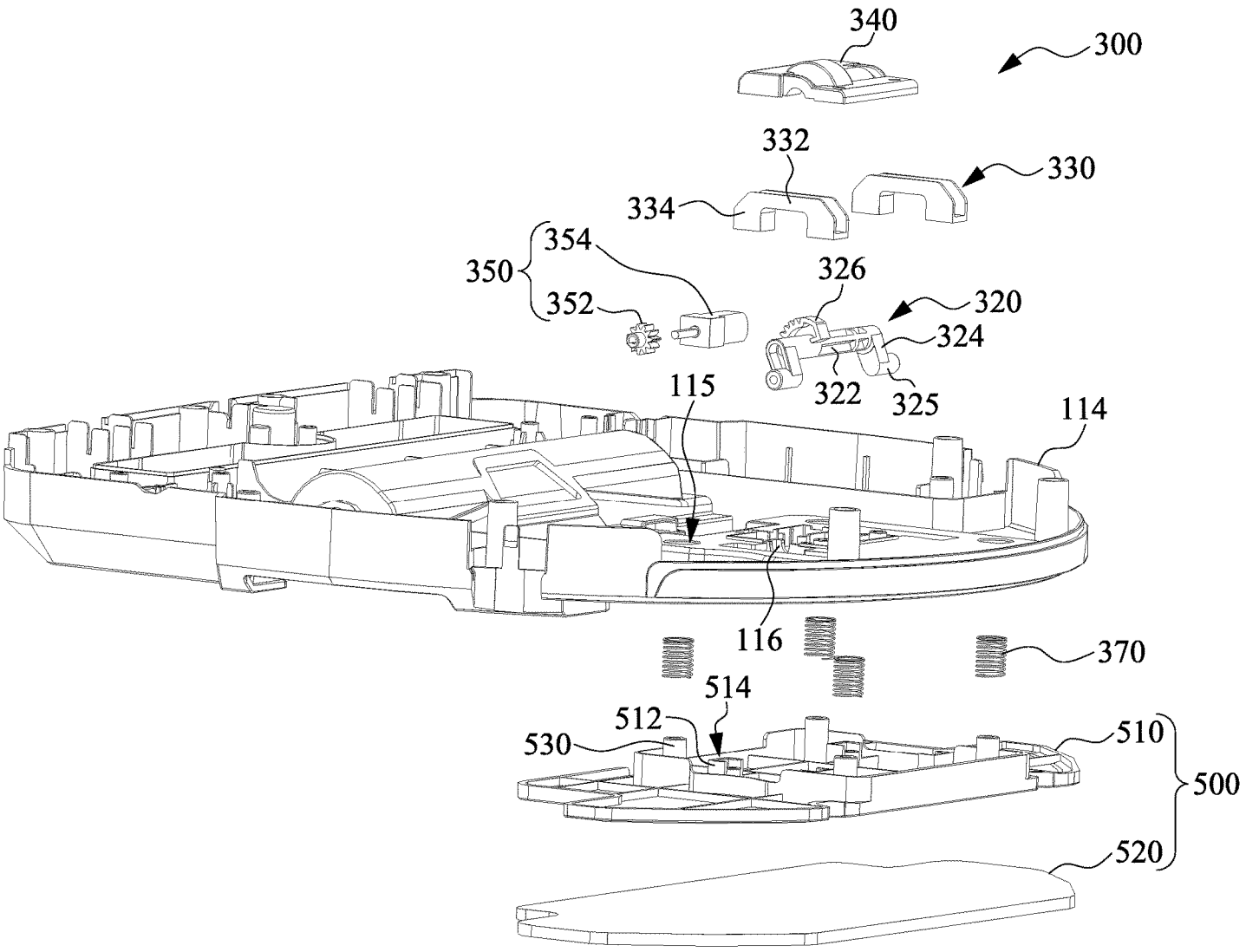
FIG. 8 shows a three-dimensional exploded view of a lifting device in accordance with some embodiments of the present disclosure.

In one embodiment, as shown in FIG. 8, the self-moving cleaning device 100 includes a lifting device 300, which is disposed on the base 114. The lifting device 300 is connected to the base 114 and the mopping module 500, and may move the mopping module 500 up and down relative to the base 114, so that the cloth 520 is close to or away from the surface to be cleaned. In one embodiment, the cloth seat 510 approaches the surface to be cleaned in a direction perpendicular to the surface to be cleaned, so that the cloth 520 may completely contact to the surface to be cleaned. In one embodiment, the cloth seat 510 is raised from the surface to be cleaned in a direction perpendicular to the surface to be cleaned and is at a distance from the surface to be cleaned, so that the cloth 520 may be completely separated from the surface to be cleaned.

There are many advantages provided by the design of the mopping module 500 and the cloth seat 510 that may move up and down as described above. When the self-moving cleaning device 100 needs to pass over an obstacle (such as a door sill), the mopping module 500 may be raised to increase the space below the base 114, so that the self-moving cleaning device 100 may pass over the obstacle easily. In one embodiment, when the self-moving cleaning device 100 finishes cleaning, the cloth 520 may be soiled. Therefore, raising the mopping module 500 may avoid secondary pollution when the mobile cleaning device 100 passes through a cleaned area. In another embodiment, the self-moving cleaning device 100 may travel on surfaces included of different materials, wherein some of the surfaces may not be suitable for cleaning in a wet mode, such as carpets. In such embodiment, the self-moving cleaning device 100 includes a surface detector (not shown) to detect the material of the surface. When the surface detector determines that the material of the surface is not suitable for cleaning in the wet mode, the self-moving cleaning device 100 may raise the mopping module 500 to prevent the surface from being wetted. In one embodiment, the current or the load torque of the roller brush may be used to determine whether to lift the mopping module 500. In one embodiment, the surface detector may be a surface material sensor, which may be a sound wave sensor, a light sensor or a polarized light sensor, and may use a signal of sound, light or polarized light to determine the surface material. In one embodiment, when the self-moving cleaning device 100 senses a signal indicating low battery power, the self-moving cleaning device 100 may confirm that it has returned to the charging stand via confirmation of the charging signal, and may lift the mopping module 500 to avoid wetting the surface.

In one embodiment, the mopping module 500 includes the cloth seat 510 and the cloth 520, wherein the cloth 520 is disposed on a bottom surface of the cloth seat 510. The cloth seat 510 includes a guide column 530, which passes through a guide hole 115 of the base 114, so that the cloth seat 510 moves along a long axis of the guide column 530. In one embodiment, a spring 370 is disposed on the guide column 530, wherein two ends of the spring 370 press against the base 114 and the cloth seat 510, respectively. In one embodiment, the guide column 530 is formed as a hollow polygonal column or a hollow semicircular column, and the spring 370 is disposed in the guide column 530. Referring to FIG. 8, in one embodiment, the cloth seat 510 includes a positioning seat 512, wherein the positioning seat 512 defines a positioning space 514 for receiving a linking member 334.

Figure 9:
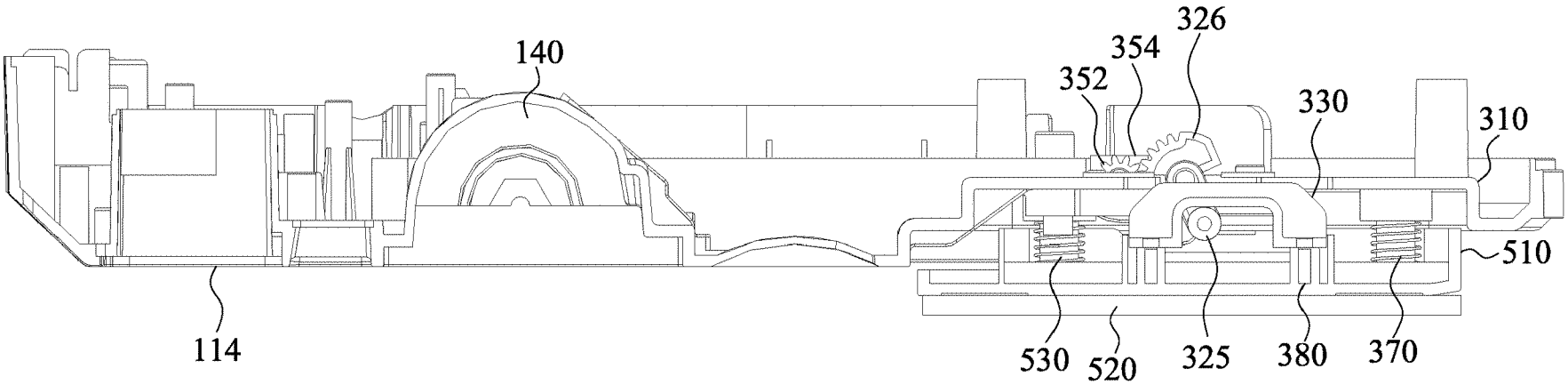
FIG. 9 shows a schematic view of the lifting device in a laid down position in accordance with some embodiments of the present disclosure.

FIG. 8 shows a three-dimensional exploded view of the lifting device 300 in accordance with some embodiments of the present disclosure. FIG. 6B shows a schematic diagram of raising the lifting device in accordance with some embodiments of the present disclosure, and FIG. 9 shows a schematic diagram of lowering the lifting device in accordance with some embodiments of the present disclosure. Referring to FIGS. 4, 5, 6B, 8 and 9, the lifting device 300 includes a crank 320, a fixing bar 330, an upper cover 340, a driving device 350, and the spring 370. The driving device 350 is used to drive the crank 320 to rotate and includes a gear wheel 352 and a motor 354. The crank 320 includes a crankshaft 322, a crank arm 324, and a gear part 326, the base 114 includes a side wall to form a crankshaft seat 310, and the crankshaft seat 310 includes an opening 312 for allowing the crank 320 and the fixing bar 330 to pass through and move up and down with respect to the base 114. The crankshaft 322 is disposed between the crankshaft seat 310 and the upper cover 340, and the crank 320 presses against a protrusion 116 on the crankshaft seat 310 to rotate, whereby an end of the crank arm 324 is raised or lowered relative to the crankshaft seat 310 through the opening 312 of the crankshaft seat 310. In one embodiment, the protrusion 116 forms a crankshaft accommodating space for accommodating the crankshaft 322. In one embodiment, the lifting device 300 includes a pair of the fixing bars 330, respectively corresponding to two of the crank arms 324 of the crank 320, wherein each of the fixing bars 330 has a horizontal portion 332 and two linking members 334 extending downward from both sides of the horizontal portion 332. The fixing bars 330 pass through the opening 312 of the crankshaft seat 310 of the base 114. The horizontal portion 332 of the fixing bar 330 straddles the crank arm 324 of the crank 320, and the linking member 334 extends downward along the crank 320 and is connected to the mopping module 500 through the opening 312 of the crankshaft seat 310. In one embodiment, the crank arm 324 is formed with an abutment member 325, wherein the abutment member 325 extends from a side of the crank arm 324, preferably in a direction of the long axis of the crankshaft 322, and the horizontal portion 332 straddles the abutment member 325. In one embodiment, the lifting device 300 includes a fastening member 380 (such as a screw, a rivet, etc.) for fastening the cloth seat 510 of the mopping module 500 to the fixing bar 330. Preferably, the lifting device 300 may fasten the mopping module 500 to the linking member 334 of the fixing bar 330.

The gear part 326 and the crank arm 324 are respectively disposed on opposite sides of the crankshaft 322. The gear part 326 is disposed on the crankshaft 322 and is coupled to the driving device 350, whereby the driving device 350 drives the gear part 326 to rotate in a clockwise or counterclockwise direction. In one embodiment, the motor 354 is controlled based on a control current to output a rotational torque to drive the gear wheel 352, and the gear part 326 of the crank 320 meshes with the gear wheel 352 to rotate. The motor 354 may output clockwise or counterclockwise torque based on different directions of the control current, so that the motor 354 drives the gear wheel 352 and the gear part 326 to rotate clockwise or counterclockwise, thereby raising or lowering the crank arm 324 of the crank 320. When the abutment member 325 of the crank arm 324 is raised, the fixing bar 330 is also raised, so that the cloth seat 510 may also be raised accordingly, thereby raising the cloth 520 from the surface to be cleaned. Conversely, when the abutment member 325 of the crank arm 324 is lowered, the fixing bar 330 is also lowered, thereby lowering the cloth seat 510, so that the cloth 520 contacts the surface to be cleaned. Preferably, in addition to moving up and down, the crank arm 324 also moves back and forth in the direction in which the horizontal portion 332 extends (the horizontal direction in FIG. 9).

In one embodiment, the gear part 326 of the crankshaft 322 includes an upper starting point and a lower starting point, so as to determine a lifting range of the mopping module 500. Preferably, the gear part 326 is formed with a plurality of continuous gear teeth, wherein two ends of the continuous gear teeth form an upper starting point and a lower starting point, respectively. In one embodiment, by setting a number of the gear teeth of the gear part 326, the two ends of the continuous gear teeth are set to correspond to the upper starting point and the lower starting point, and when the rotation of the gear part 326 reaches either of the two ends, the gear part 326 can no longer move forward or backward, so that the rotation of the crankshaft 322 is stopped. In one embodiment, the lifting device 300 detects that an output current of the motor 354 has increased, which indicates that the gear part 326 of the crankshaft 322 has reached the upper or lower starting point, thereby stopping or reducing the supply current, which may keep the lifting device 300 to function in a normal condition.

Referring to FIG. 9, in one embodiment, the crankshaft seat 310 is connected to the cloth seat 510 via the spring 370. When the motor 354 does not output a driving torque, the spring 370 applies a force to the cloth seat 510 so that the cloth seat 510 moves toward the surface to be cleaned. At such time, the mopping module 500 can be said to be extended or laid down. When the self-moving cleaning device 100 is placed on the surface to be cleaned, the weight of the self-moving cleaning device 100 compresses the spring 370, thereby pressing the cloth 520 more firmly to the surface to be cleaned. At such time, the mopping module 500 can be said to be laid flatly or retracted. In addition, the downward force generated by the compression of the spring 370 is applied to the cloth 520 through the cloth seat 510, so that the cloth 520 is assisted with a wiping force provided by the downward force in mopping the surface, thereby improving the effect of cleaning.

In one embodiment, the fixing bars 330 are disposed at two opposite ends of the gear part 326, the crank arms 324 are disposed at two opposite ends of the gear part 326, the gear part 326 and the crank arms 324 are disposed at two opposite sides of the crankshaft 322, and the gear part 326 protrudes in a first direction and the crank arm 324 protrudes in a second direction different from or opposite to the first direction. Preferably, at least one fixing bar 330 passes through the opening 312 of the base 114, and the crankshaft 322 rotates against the protrusion 116 on the crankshaft seat 310; the fixing bar 330 passes through the opening 312 of the crankshaft seat 310.

In one embodiment, the cloth seat 510 includes the guide column 530, wherein the guide column 530 passes through the guide hole 115 of the base 114, so that the cloth seat 510 moves along the long axis of the guide column 530. Preferably, in one embodiment, the spring 370 is sleeved on the guide column 530, and the two ends of the spring 370 press against the base 114 and the cloth seat 510, respectively. The crank arm 324 includes the abutment member 325, wherein the abutment member 325 extends from the side of the crank arm 324 in the long axis direction of the crankshaft 322, and the horizontal portion 332 straddles the abutment member 325. According to this feature, the two springs 370 can be evenly compressed when the cloth seat 510 is raised, and the cloth seat 510 may be kept level without tilting while being raised. Preferably, referring to FIG. 9, when viewed from a side of the self-moving cleaning device 100, the horizontal portion 332 and the abutment member 325 are disposed between the two springs 370. In one embodiment, by the rotation of the crank 320, the abutment member 325 is pressed against the horizontal portion 332, and drives the cloth seat 510 close to the base 114, retracting the cloth seat 510. At such time, the abutment member 325 is between the two springs 370, which helps maintain the cloth seat 510 at a level orientation while being raised or lowered. In another embodiment, when the abutment member 325 is lowered to the lowest level, the cloth seat 510 may be said to be in a lowered state, and the abutment member 325 is between the two springs 370, which further helps maintain the cloth seat 510 at a level orientation while being raised or lowered. In another embodiment, when the cloth seat 510 is between the retracted state and the lowered state, the abutment member 325 is between the two springs 370.

In one embodiment, the self-moving cleaning device 100 further includes a circuit board 190 including a controller, which is configured to perform, when the self-moving cleaning device 100 moves on the surface to be cleaned, following steps in sequence: the first suction port 122 is used for vacuuming, the second suction port 124 is used for vacuuming, the spray module 160 is used for spraying, and the mopping module 500 with the cloth 520 is used for mopping.

The foregoing outlines features of several embodiments so that those skilled in the art may better understand aspects of the present disclosure. Those skilled in the art should appreciate that they may readily use the present disclosure as a basis for designing or modifying other operations and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The invention claimed is:

1. A self-moving cleaning device, comprising:

a base;

a mobile module adjacent to the base and configured to contact a surface when the self-moving cleaning device moves on the surface;

a vacuum module arranged over the base;

a dust box arranged over the base and connected to the vacuum module, the dust box comprising a first opening and a second opening, wherein the first opening is oriented in a first direction different from a second direction in which the second opening is oriented;

a first suction port arranged on the base and comprising a first suction inlet connected to the first opening, wherein the first suction port is free of any bristle or brush blade;

a second suction port arranged on the base and comprising a second suction inlet connected to the second opening, the first suction port disposed between a front side of the base and the second suction port;

a roller brush device arranged on the base and within the second suction port; and an air duct, wherein the first suction port is connected to the dust box through the air duct to thereby connect the first suction inlet to the first opening, wherein the dust box comprises:

a bottom surface, wherein the second opening is higher than the bottom surface by a first distance; and a side wall arranged near the second opening to serve as a barrier wall to surround the second opening from an inside of the dust box so that the side wall and the bottom surface form a debris-accommodating space; and the second suction inlet is adjacent to the first suction inlet, wherein a distance between the first suction inlet and the second suction inlet is equal to or less than 30 mm.

2. The self-moving cleaning device according to claim 1, wherein the air duct comprises a choke valve configured to open or close the air duct to allow or block an entry of an airflow into the first opening.

3. The self-moving cleaning device according to claim 1, wherein:

the first opening protrudes forward farther than the second opening, and the first opening and the second opening do not overlap in a vertical direction from a side view respective.

4. The self-moving cleaning device according to claim 1, further comprising a plurality of first blocking sheets disposed between the first suction inlet and the second suction inlet and extending outward from the base to contact the surface when the self-moving cleaning device moves on the surface, wherein a distance between the first suction inlet and the second suction inlet is between 5 mm and 20 mm.

5. The self-moving cleaning device according to claim 4, wherein the plurality of first blocking sheets comprises a first subset and a second subset, and two adjacent first blocking sheets in the first subset or the second subset are separated by a first spacing.

6. The self-moving cleaning device according to claim 5, wherein the first spacing is less than a spacing between the first subset and the second subset; and the first subset and the second subset together form a row, which is parallel to the first suction inlet.

7. The self-moving cleaning device according to claim 4, further comprising a second blocking sheet disposed on a side of the second suction inlet opposite to the first blocking sheets, wherein a length of the second blocking sheet is greater than a length of the first suction inlet.

8. The self-moving cleaning device according to claim 1, further comprising a side brush device disposed on a side of the base, the side brush device comprising a rotating shaft and at least one bristle attached to the rotating shaft, wherein the self-moving cleaning device further comprises a third blocking sheet disposed between the first suction inlet and the front side of the base, and wherein the third blocking sheet is disposed within a radius of rotation of the at least one bristle.

9. The self-moving cleaning device according to claim 1, further comprising a spray module disposed on the base and extending outwardly, wherein the second suction port is disposed between the first suction port and the spray module.

10. The self-moving cleaning device according to claim 9, further comprising a mopping module connected to the base and configured to mop the surface when the self-moving cleaning device moves on the surface, wherein the spray module is disposed between the second suction port and the mopping module, and wherein an area of the second suction port is greater than an area of the first suction port.

11. The self-moving cleaning device according to claim 10, further comprising a lifting device connected to the base and the mopping module, the lifting device configured to move the mopping module close to or away from the base, wherein the mopping module comprises:

a cloth seat; and a cloth arranged on a bottom surface of the cloth seat, wherein the lifting device comprises:

a crank;

a driving device configured to cause a rotation of the crank; and at least one fixing bar straddling the crank and connected to the cloth seat, and wherein the at least one fixing bar is configured to move the cloth seat close to or away from the base through the rotation of the crank.

12. The self-moving cleaning device according to claim 11, wherein the crank comprises:

a crankshaft arranged on the base;

at least one crank arm connected to the crankshaft; and a gear part arranged on the crankshaft and coupled to the driving device, whereby the driving device causes a rotation of the crankshaft in a clockwise or counter-clockwise direction through the gear part, and the driving device moves an end of the at least one crank arm close to or away from the base through the rotation of the crankshaft, wherein, the gear part and the at least one crank arm are disposed on two opposite sides of the crankshaft, the at least one crank arm comprises an abutment member, and the abutment member extends outward from a side of the at least one crank arm in a direction of a longitudinal axis of the crankshaft, and the at least one fixing bar comprises:

a horizontal portion straddling the abutment member of the at least one crank arm of the crankshaft; and at least one linking member extending from at least an end of the horizontal portion to a lower side of the self-moving cleaning device, wherein the cloth seat is fastened to the at least one linking member.

13. The self-moving cleaning device according to claim 12, wherein the lifting device further comprises at least one spring connected to the base and the mopping module, wherein the at least one spring is configured to provide a downward force to the mopping module when the self-moving cleaning device moves on the surface, wherein the at least one spring comprises a first spring and a second spring, and the horizontal portion and the abutment member are disposed between the first spring and the second spring from an elevation view.

14. A self-moving cleaning device, comprising:

a base;

a mobile module adjacent to the base and configured to contact a surface when the self-moving cleaning device moves on the surface;

a vacuum module arranged over the base;

a dust box arranged over the base and connected to the vacuum module, the dust box comprising a first opening and a second opening, wherein the first opening is oriented in a first direction different from a second direction in which the second opening is oriented;

a first suction port arranged on the base and comprising a first suction inlet connected to the first opening, wherein the first suction port is free of any bristle or brush blade;

a second suction port arranged on the base and comprising a second suction inlet connected to the second opening, the first suction port disposed between a front side of the base and the second suction port;

a roller brush device arranged on the base and within the second suction port; and an air duct, wherein the first suction port is connected to the dust box through the air duct to thereby connect the first suction inlet to the first opening, wherein the first opening is disposed over the roller brush device, and the first opening is disposed over the second opening;

wherein the dust box comprises:

a front side wall;

a bottom surface; and an inclined surface between the front side wall and the bottom surface, wherein the second opening is arranged on the inclined surface;

wherein a first included angle is formed between the first opening and the bottom surface, and a second included angle is formed between the second opening and the bottom surface of the dust box, wherein the first included angle is greater than the second included angle;

wherein the air duct extends, conformal to a shape of a sidewall of the second suction port of the base, from the first suction port to a location over the roller brush device, thereby connecting the air duct to the dust box, wherein a shape of the inclined surface corresponds to a wall of the air duct and conforms to the shape of the sidewall of the second suction port, and the dust box and the second suction port are arrangement in a compact manner.

15. A self-moving cleaning device, comprising:

a base;

a mobile module adjacent to the base and configured to contact a surface when the self-moving cleaning device moves on the surface;

a vacuum module arranged over the base;

a dust box arranged over the base and connected to the vacuum module, the dust box comprising a first opening and a second opening, wherein the first opening is oriented in a first direction different from a second direction in which the second opening is oriented;

a first suction port arranged on the base and comprising a first suction inlet connected to the first opening, wherein the first suction port is free of any bristle or brush blade;

a second suction port arranged on the base and comprising a second suction inlet connected to the second opening, the first suction port disposed between a front side of the base and the second suction port;

a roller brush device arranged on the base and within the second suction port; and an air duct, wherein the first suction port is connected to the dust box through the air duct to thereby connect the first suction inlet to the first opening, wherein an included angle formed by the first opening and a bottom surface of the dust box is a first acute angle, and an included angle formed by the second opening and the bottom surface of the dust box is a second acute angle, wherein the first acute angle is greater than the second acute angle.

16. The self-moving cleaning device according to claim 15, comprising:

a spray module disposed on the base;

a mopping module disposed between the base and the surface and configured to contact the surface during operation, wherein the first suction port, the second suction port, the spray module, and the mopping module are arranged in sequence from the front side of the base to a back side of the base; and a controller configured to perform following steps in sequence when the self-moving cleaning device moves on the surface:

vacuuming an area through the first suction port;

vacuuming the area through the second suction port;

performing spraying the area with the spray module; and performing mopping the area with the mopping module.

17. The self-moving cleaning device according to claim 15, wherein the first opening is disposed over the roller brush device, and the first opening is disposed over the second opening; and the second opening is higher than the bottom surface by a first distance.

18. The self-moving cleaning device according to claim 15, wherein the first suction port is connected to the dust box through the air duct so as to connect the first suction inlet to the first opening, and the air duct comprises a choke valve configured to open or close the air duct to allow or block an entry of an airflow to the first opening.

19. The self-moving cleaning device according to claim 15, wherein the air duct comprises a third opening connected to the first suction inlet, wherein an area of the third opening is greater than an area of the first opening.

20. The self-moving cleaning device according to claim 15, further comprising a plurality of first blocking sheets disposed between the first suction inlet and the second suction inlet and extending outward from the base.

* * * * *